US011600180B2

(12) United States Patent
Kamiya et al.

(10) Patent No.: US 11,600,180 B2
(45) Date of Patent: Mar. 7, 2023

(54) METHOD AND APPARATUS FOR OPTIMIZING EFFICIENCY OF A TRANSPORT PROVIDER

(71) Applicant: NEC CORPORATION, Tokyo (JP)

(72) Inventors: Yuki Kamiya, Singapore (SG); Raymond Leong, Singapore (SG); Konstantinos Gkiotsalitis, Heidelberg (DE); Nitin Maslekar, Heidelberg (DE)

(73) Assignee: NEC CORPORATION, Tokyo (JP)

( * ) Notice: Subject to any disclaimer, the term of this patent is extended or adjusted under 35 U.S.C. 154(b) by 484 days.

(21) Appl. No.: 16/629,798

(22) PCT Filed: Jul. 3, 2018

(86) PCT No.: PCT/JP2018/025171
§ 371 (c)(1),
(2) Date: Jan. 9, 2020

(87) PCT Pub. No.: WO2019/013041
PCT Pub. Date: Jan. 17, 2019

(65) Prior Publication Data

US 2021/0142670 A1 May 13, 2021

(30) Foreign Application Priority Data

Jul. 10, 2017 (SG) ..... 10201705665P

(51) Int. Cl.
*G08G 1/00* (2006.01)
*G08G 1/127* (2006.01)
*G06Q 50/30* (2012.01)

(52) U.S. Cl.
CPC ..... *G08G 1/127* (2013.01); *G06Q 50/30* (2013.01)

(58) Field of Classification Search
CPC ..... G08G 1/127; G06Q 50/30
See application file for complete search history.

(56) References Cited

U.S. PATENT DOCUMENTS 9,159,238 B2 * 10/2015 Manolescu ..... G08G 1/20
2012/0010803 A1 * 1/2012 Min ..... G08G 1/123 703/8
2017/0043798 A1 2/2017 Kawabata et al.

FOREIGN PATENT DOCUMENTS

EP 1417664 A1 5/2004
EP 2853467 A1 4/2015
(Continued)

OTHER PUBLICATIONS

Indian Office Action for IN Application No. 201917053737 dated Mar. 23, 2021.
(Continued)

*Primary Examiner* — Truc M Do
(74) *Attorney, Agent, or Firm* — Sughrue Mion, PLLC

(57) ABSTRACT

In a first aspect, a method for optimizing efficiency of a transport provider is provided, comprising: receiving, by a processor, a first departure time of a vehicle, which is administered by the transport provider, at a first location; receiving, by the processor, a second departure time of the vehicle at a second location which is located after the first location; determining, by the processor, a difference between the first departure time and the second departure time; and updating, by the processer, a current schedule to provide an updated schedule in response to the determination of the difference, the updated schedule indicating an updated estimated arrival time of the vehicle at a location after the second location.

16 Claims, 19 Drawing Sheets

(56) References Cited

FOREIGN PATENT DOCUMENTS

| | | | |
|---|---|---|---|
| JP | 2015-184779 | A | 10/2015 |
| JP | 2016-157273 | A | 9/2016 |
| WO | 2015/036266 | A1 | 3/2015 |

OTHER PUBLICATIONS

Written Opinion for PCT/JP2018/025171, dated Oct. 9, 2018.
International Search Report for PCT/JP2018/025171, dated Oct. 9, 2018.
Singapore Office Action for SG Application No. 11201912406U dated Jan. 13, 2021.

* cited by examiner

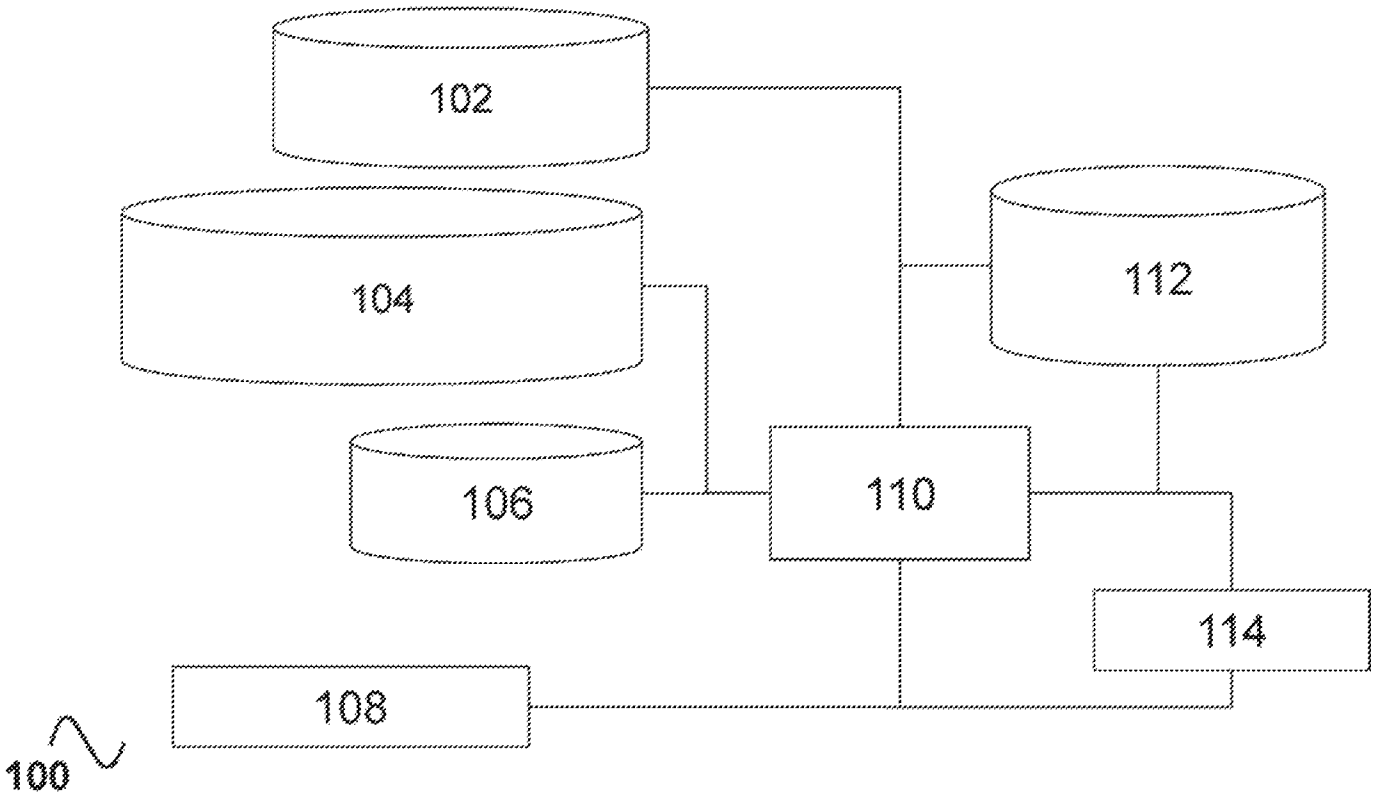
[Fig. 1A]

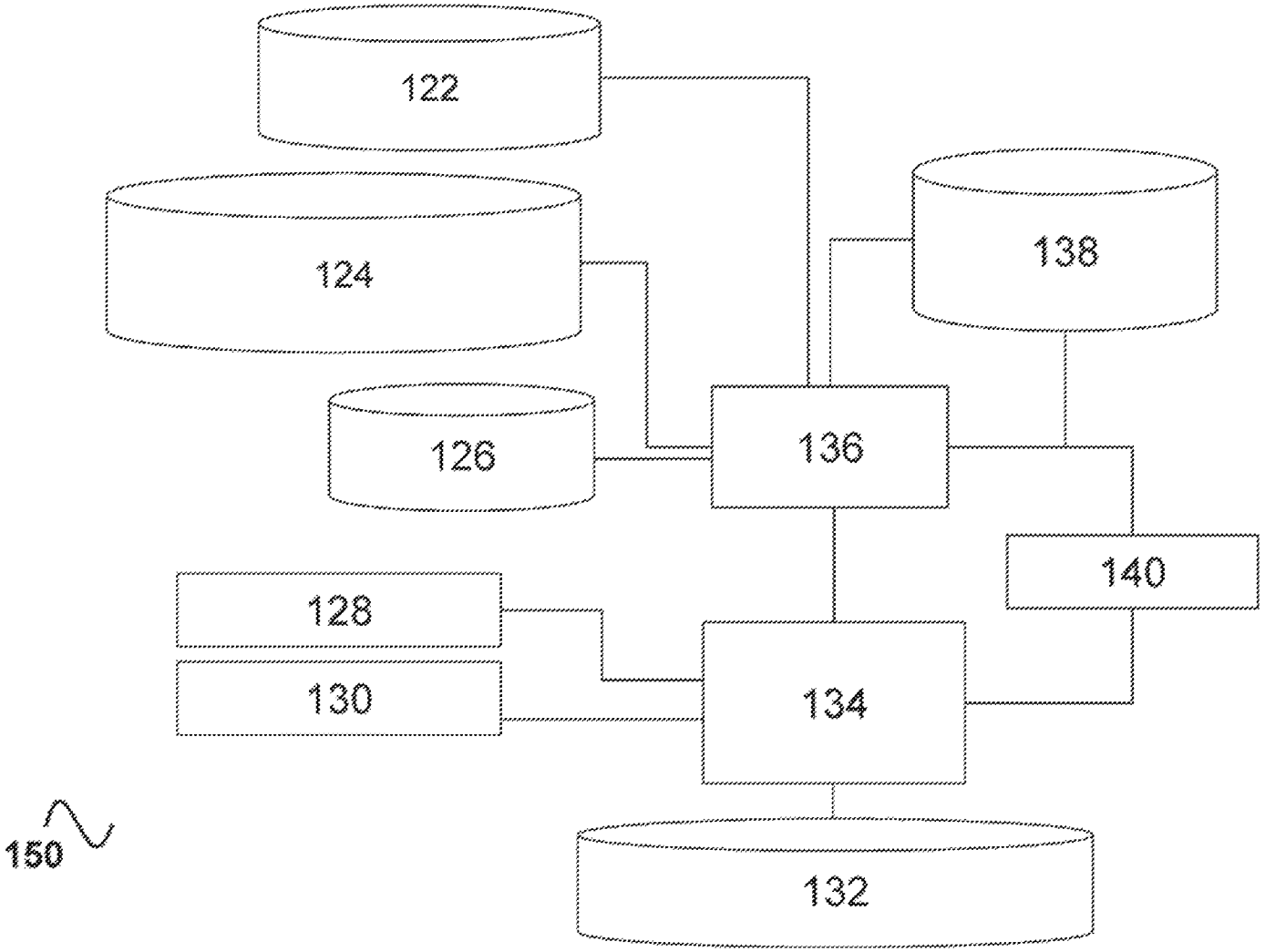
[Fig. 1B]

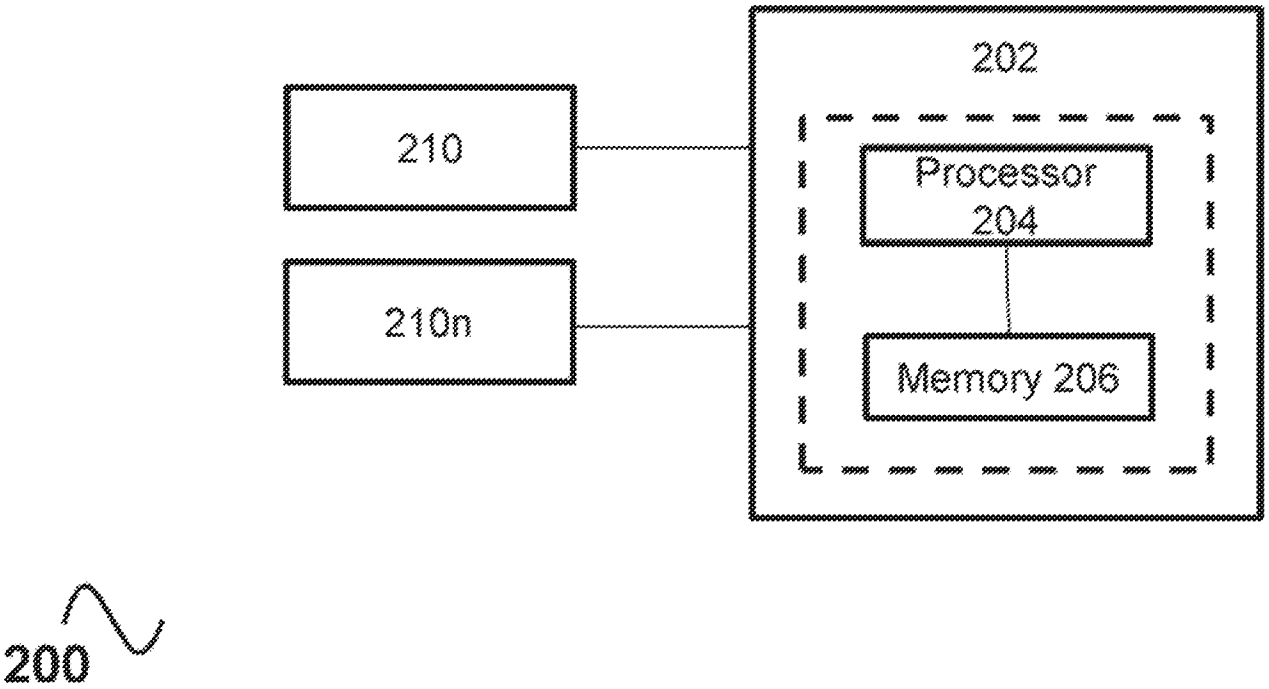
[Fig. 2]

[Fig. 3]
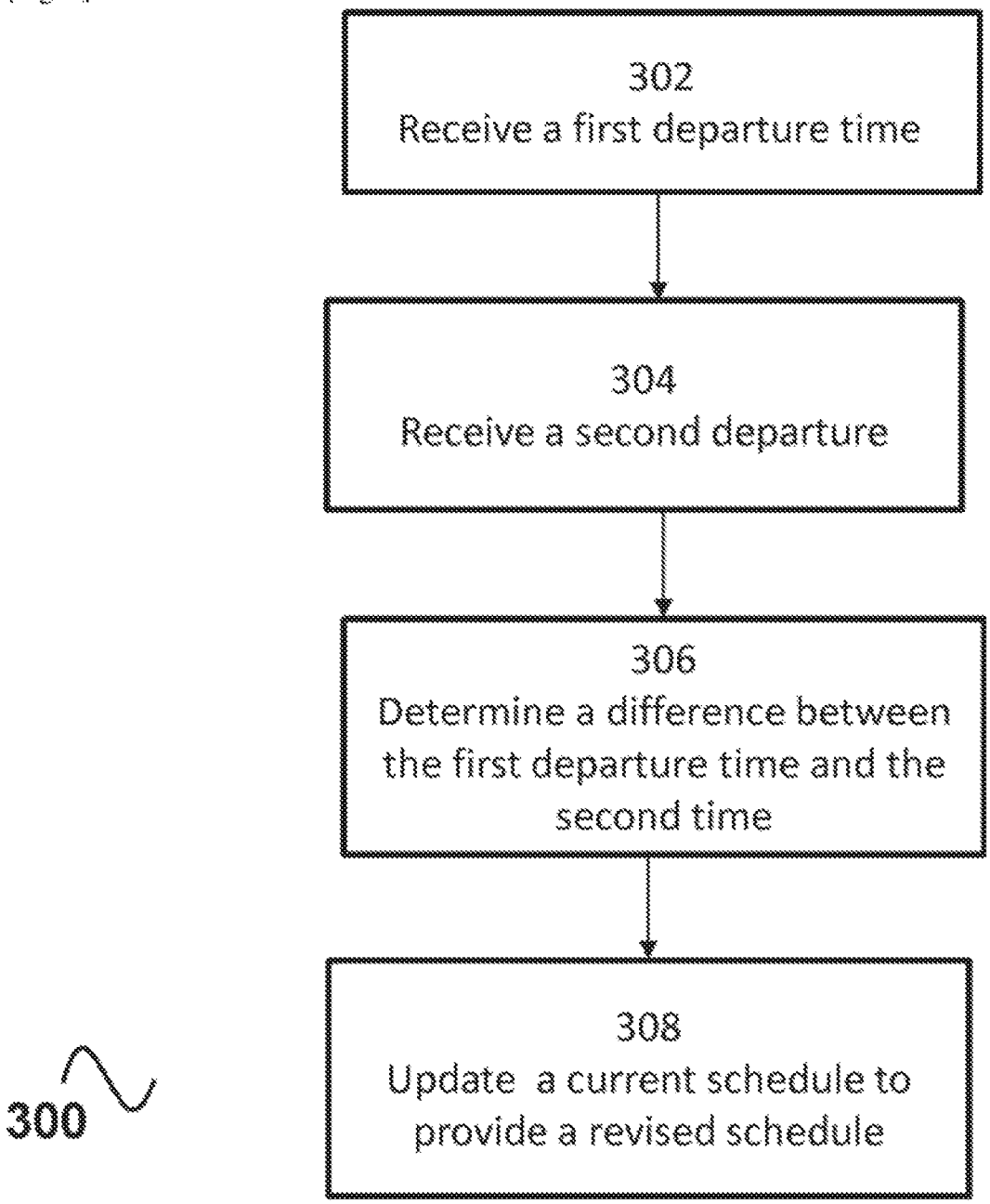

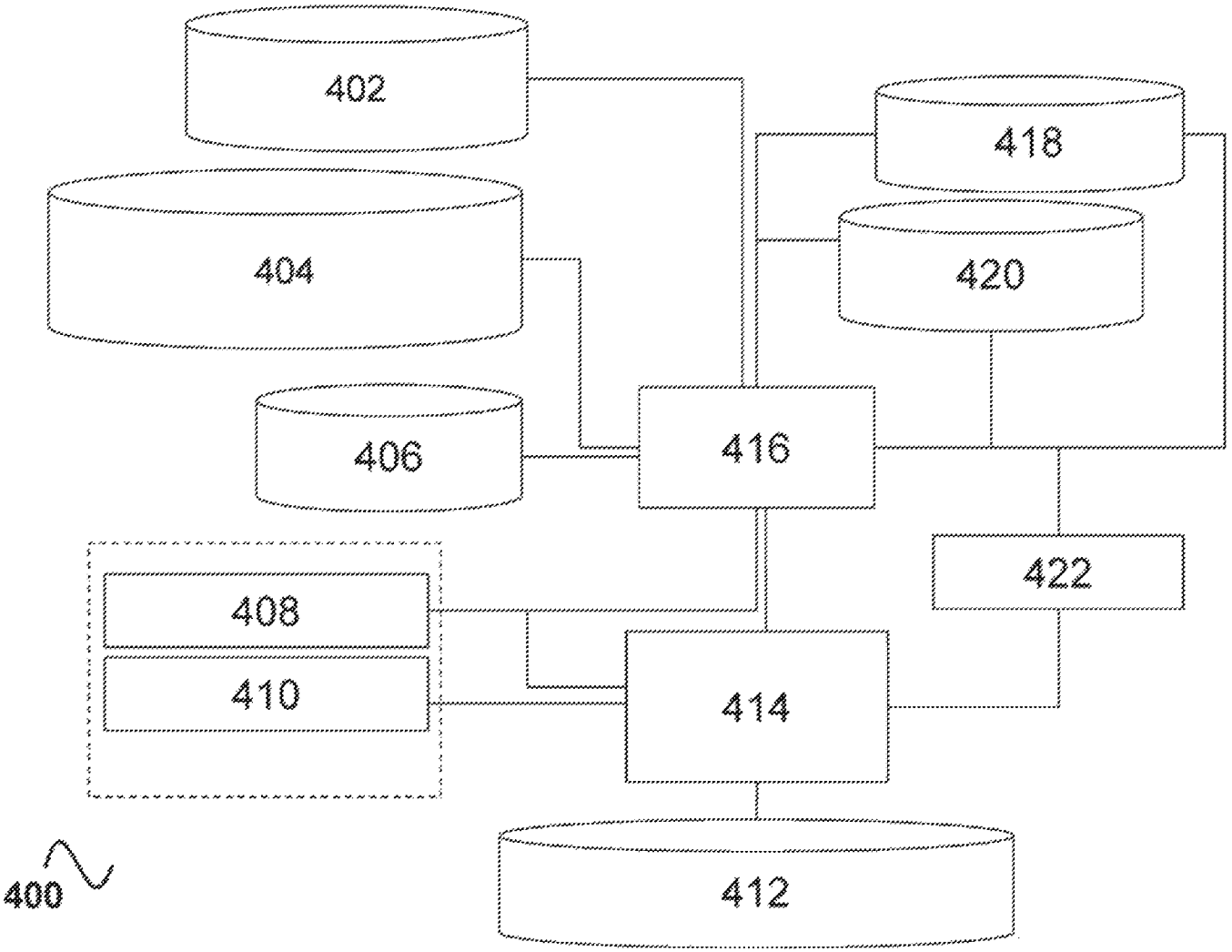
[Fig. 4]

[Fig. 5A]
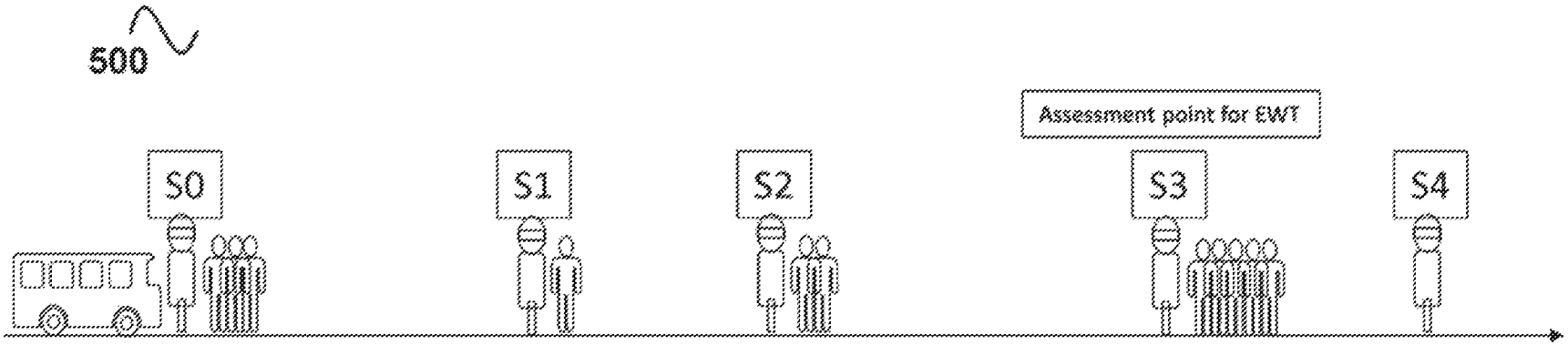
Initial Schedule
| TripID | S0 | S1 | S2 | S3 | S4 |
|---|---|---|---|---|---|
| T101 | 6:00 | 6:15 | 6:25 | 6:40 | 6:50 |
| T102 | 6:20 | 6:35 | 6:45 | 7:00 | 7:10 |
| T103 | 6:35 | 6:50 | 7:00 | 7:15 | 7:25 |
| T104 | 6:50 | 7:05 | 7:15 | 7:30 | 7:40 |
| ... | ... | ... | ... | ... | ... |
| T115 | 7:55 | 8:10 | 8:25 | 8:40 | 8:50 |
| T116 | 8:05 | 8:20 | 8:35 | 8:50 | 9:00 |
| ... | ... | ... | ... | ... | ... |

[Fig. 5B]
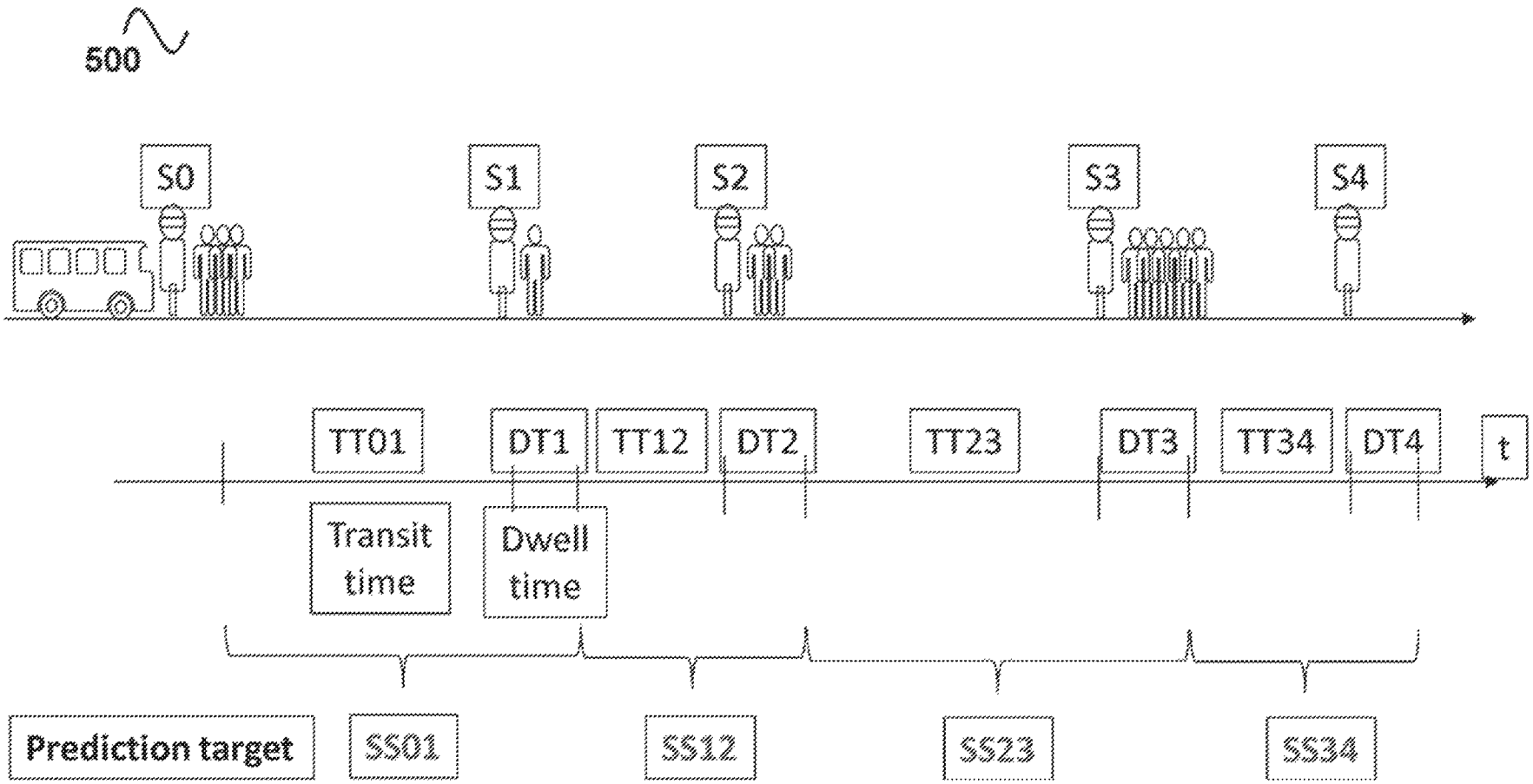

[Fig. 5C]
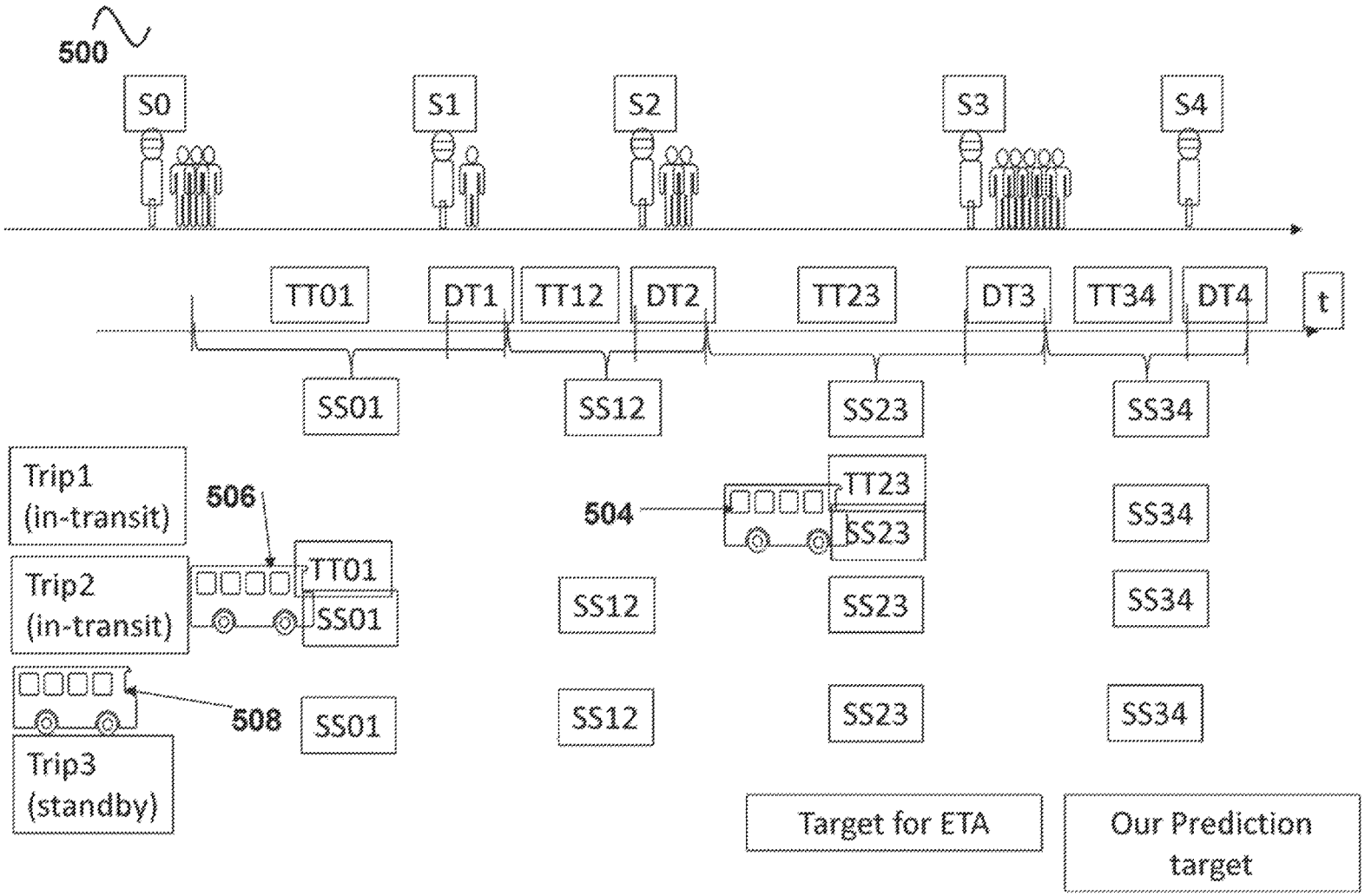

[Fig. 5D]
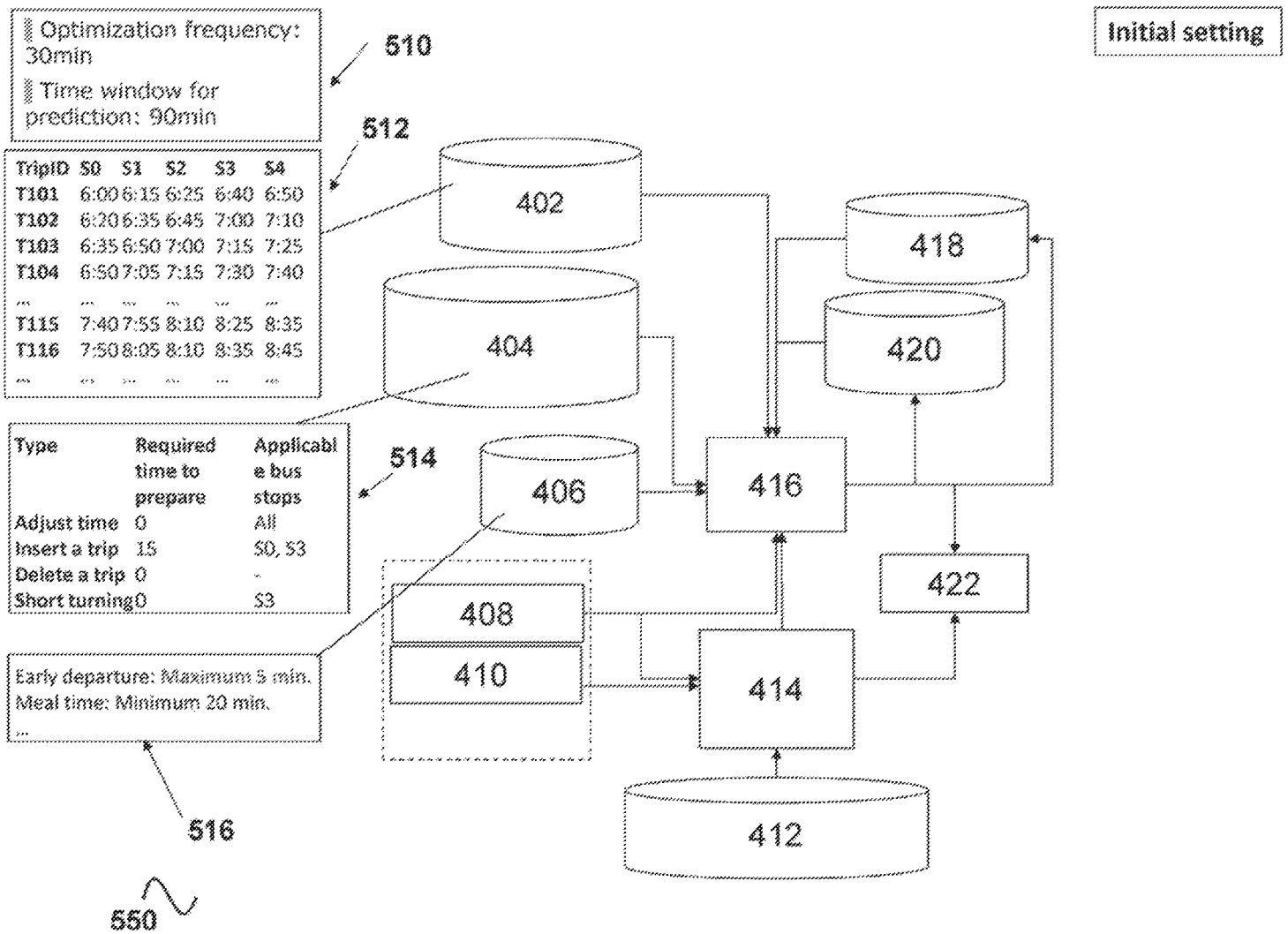

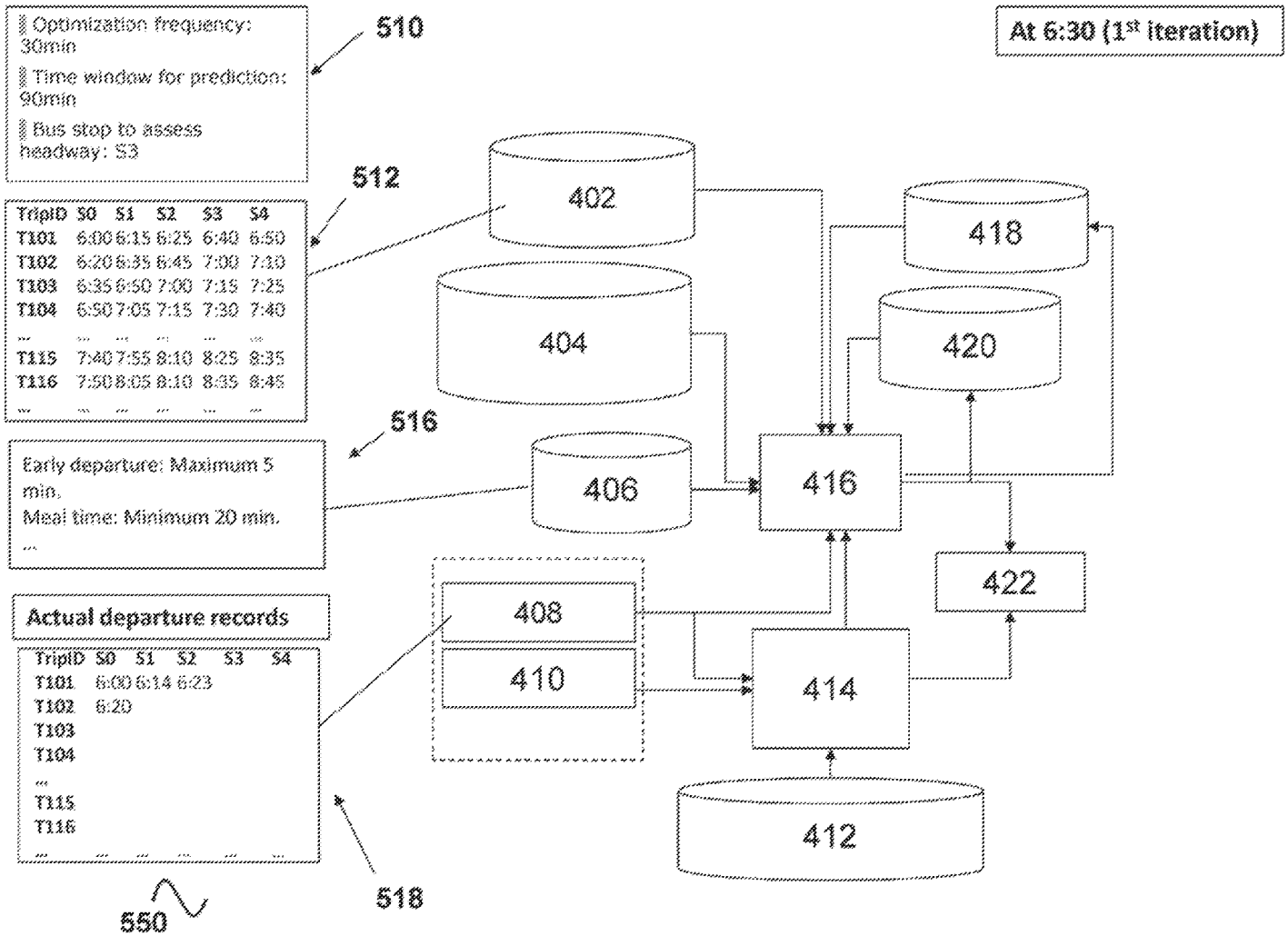
[Fig. 5E]

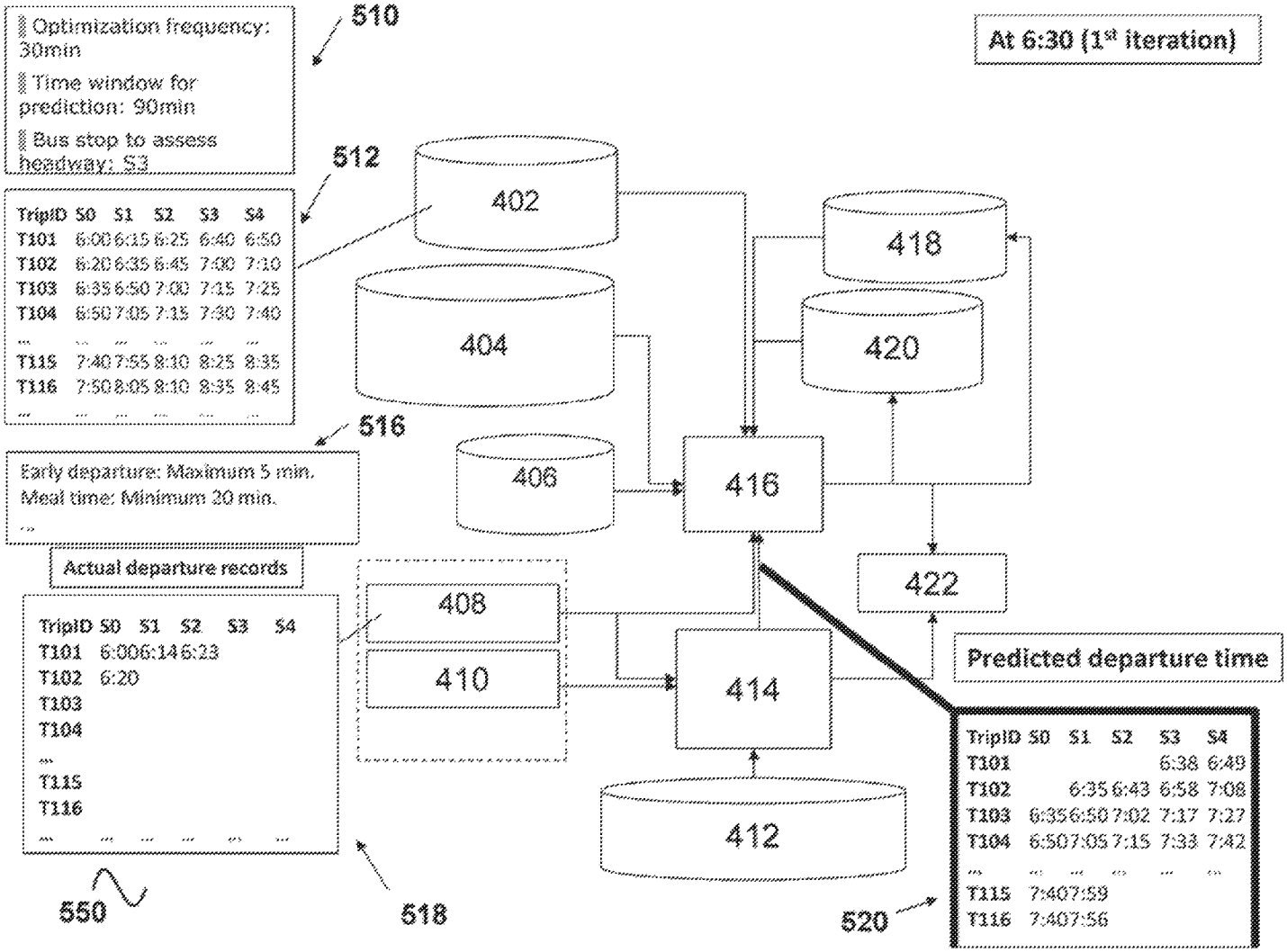
[Fig. 5F]

[Fig. 5G]
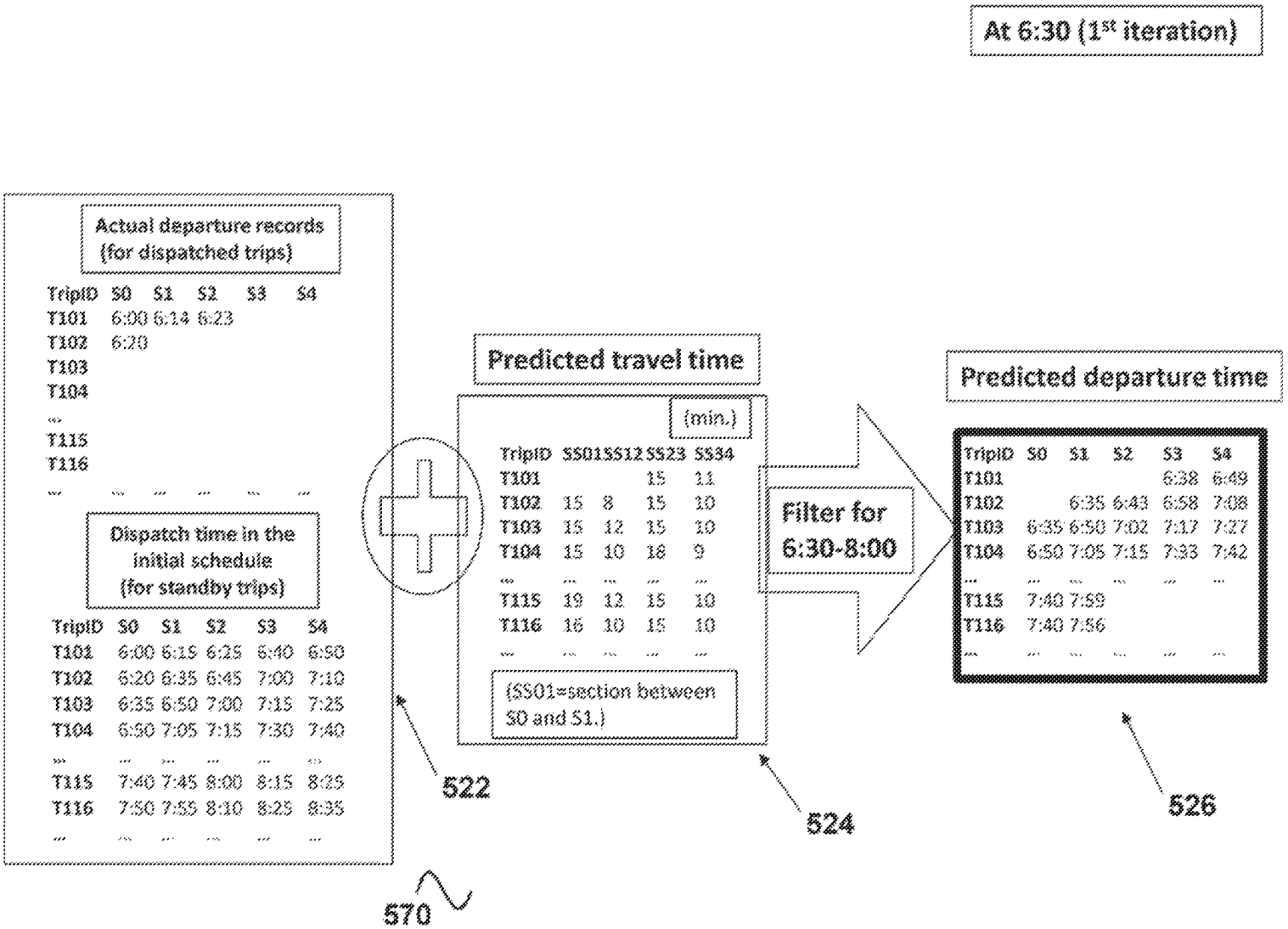

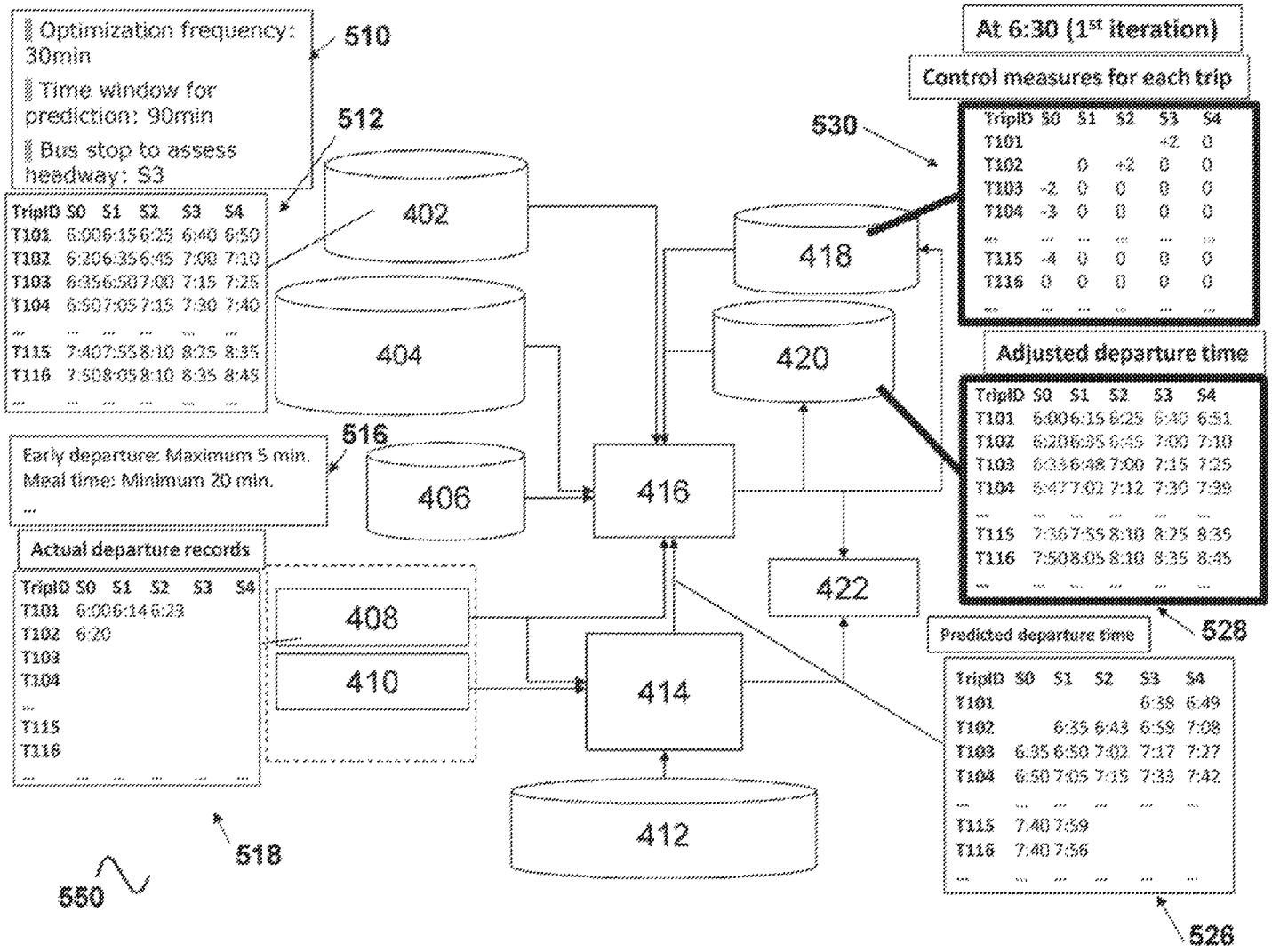
[Fig. 5H]

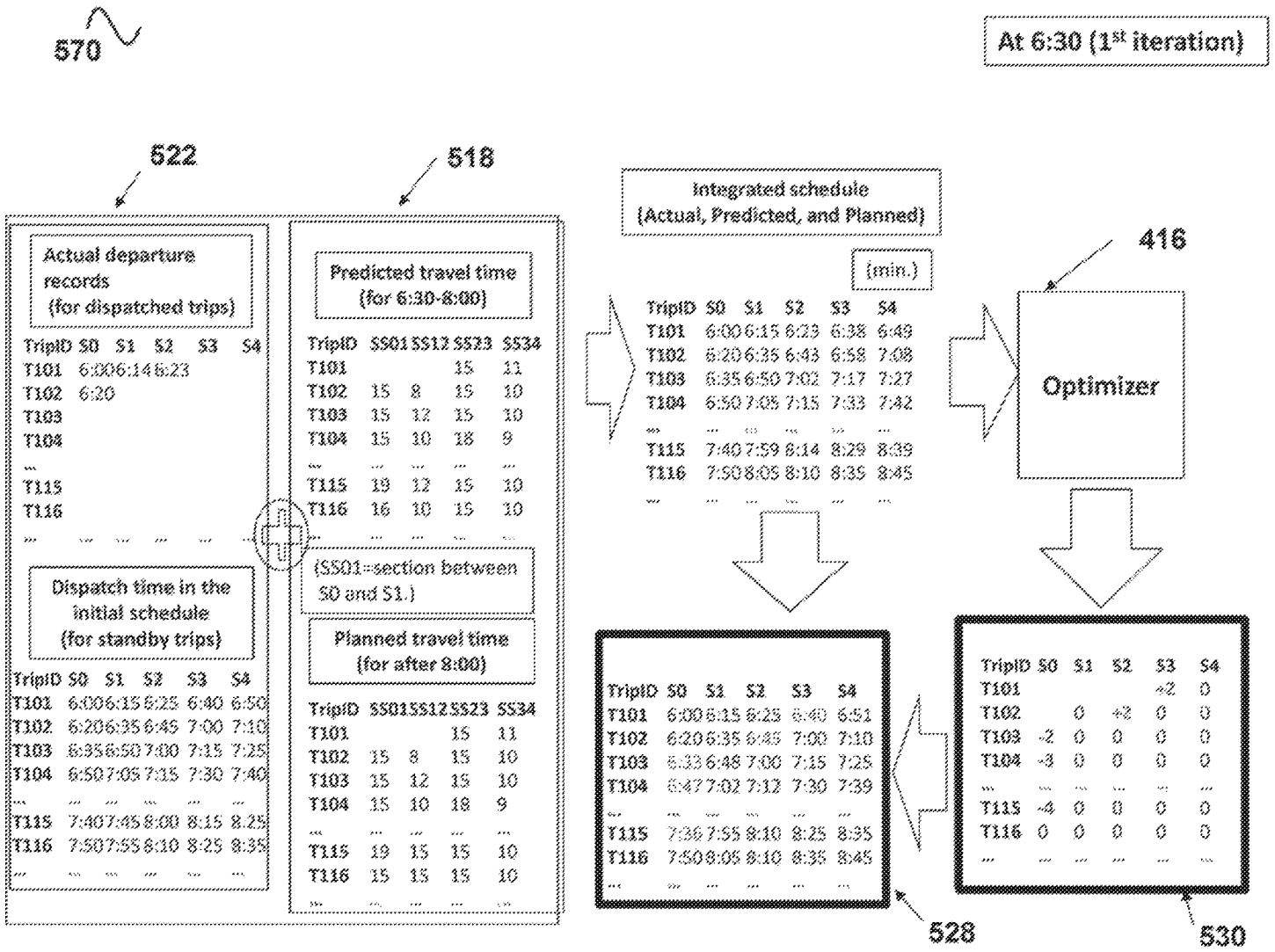
[Fig. 5I]

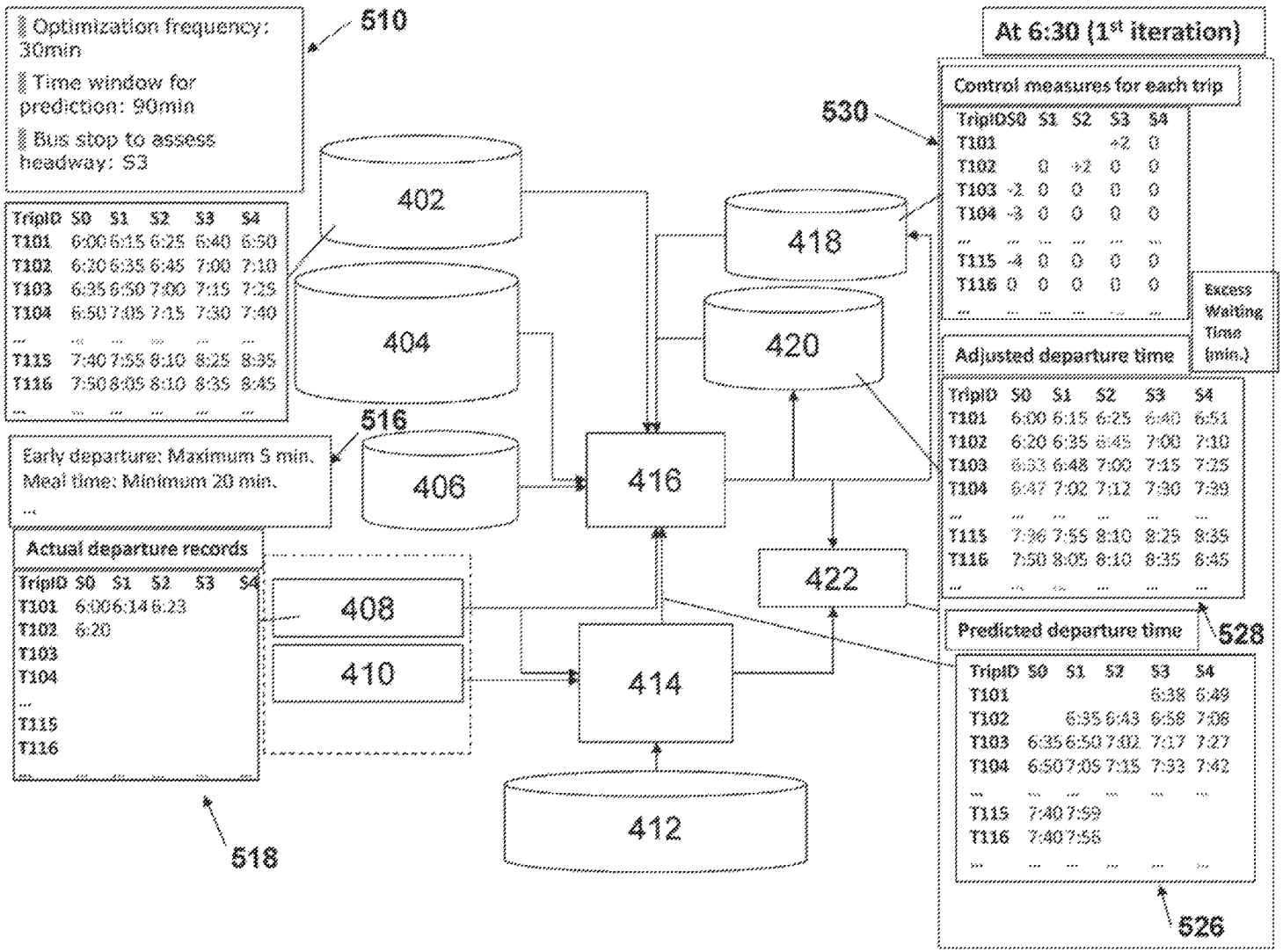
[Fig. 5J]

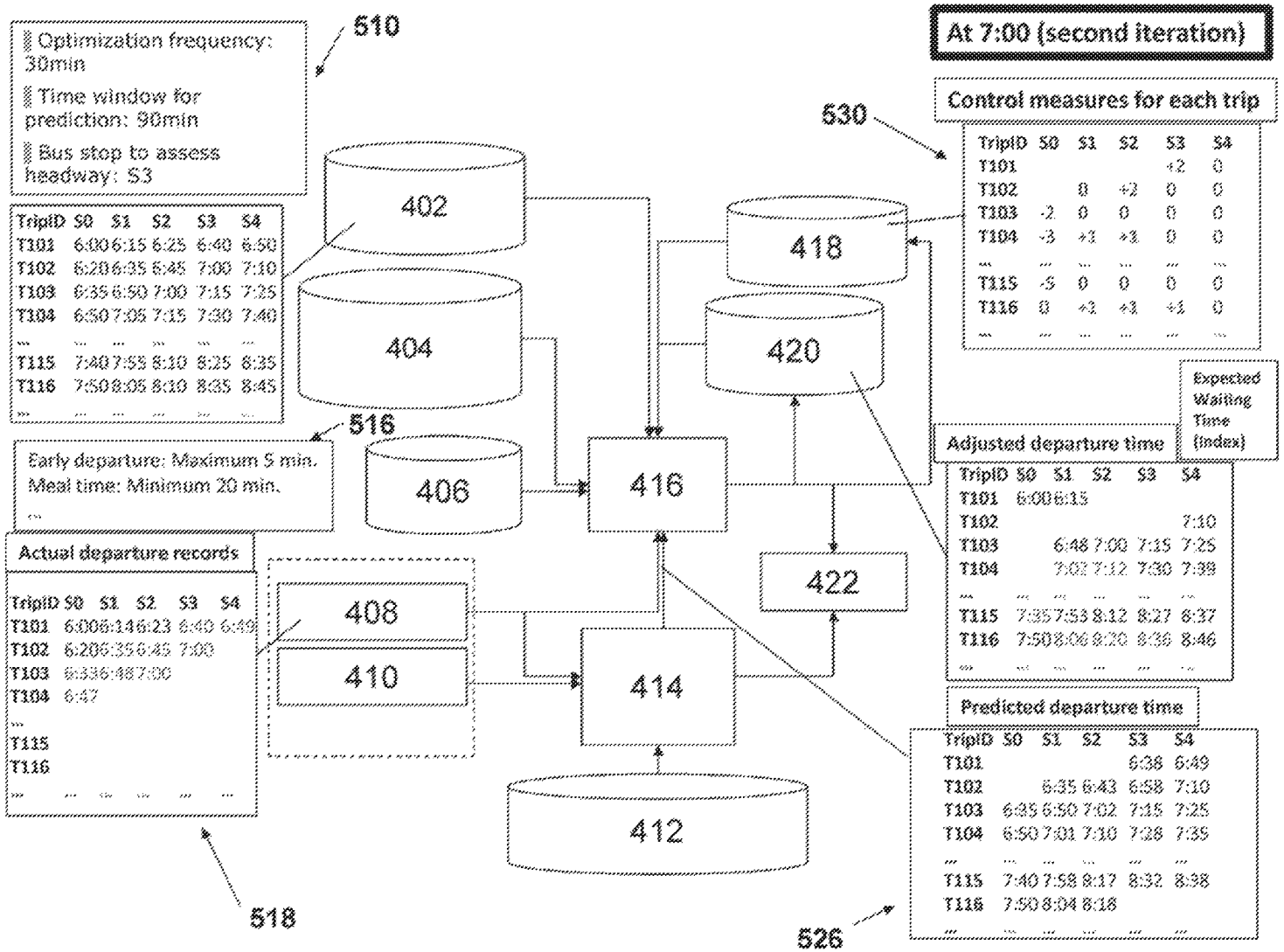
[Fig. 5K]

[Fig. 5L]
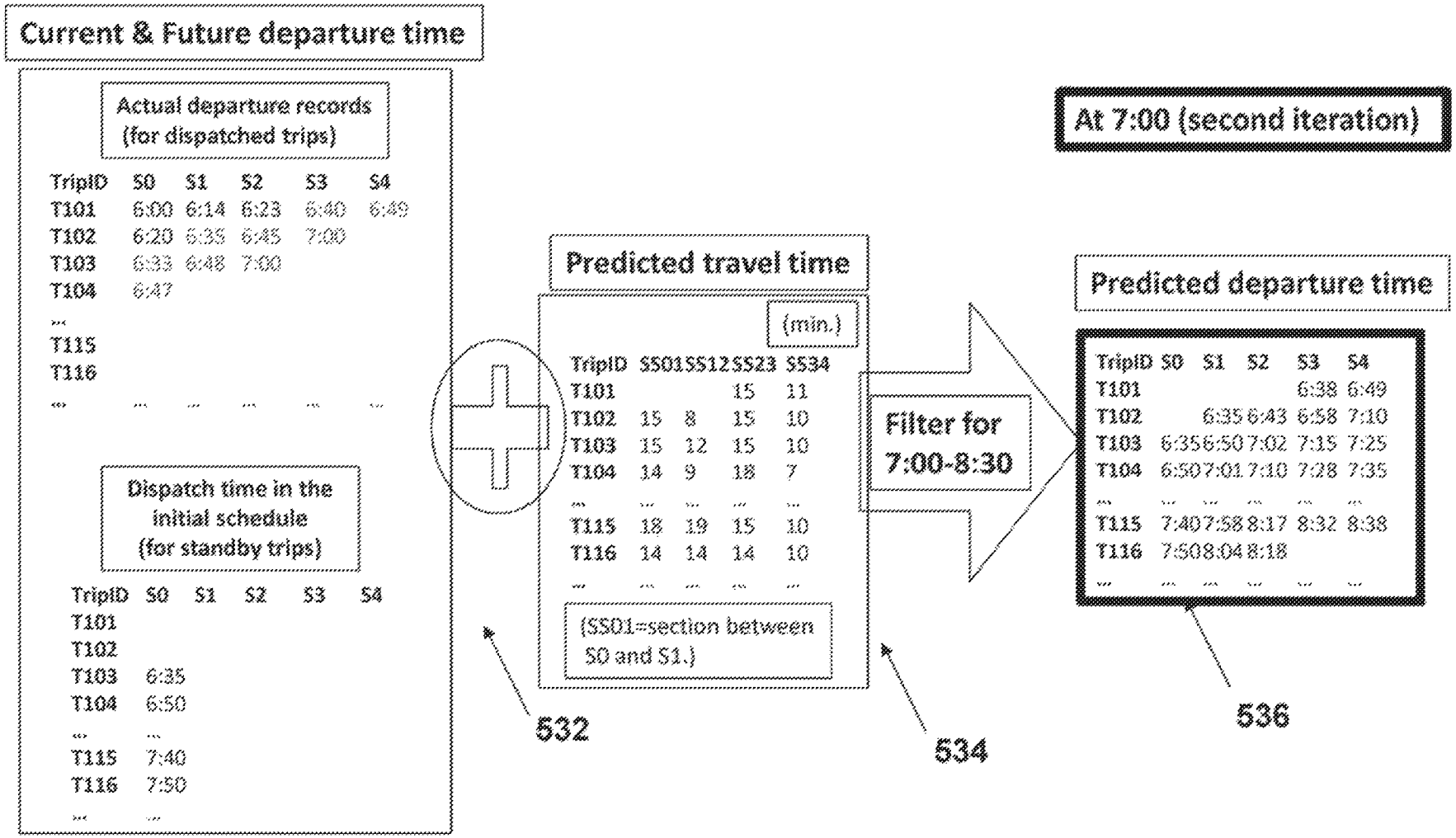

[Fig. 5M]
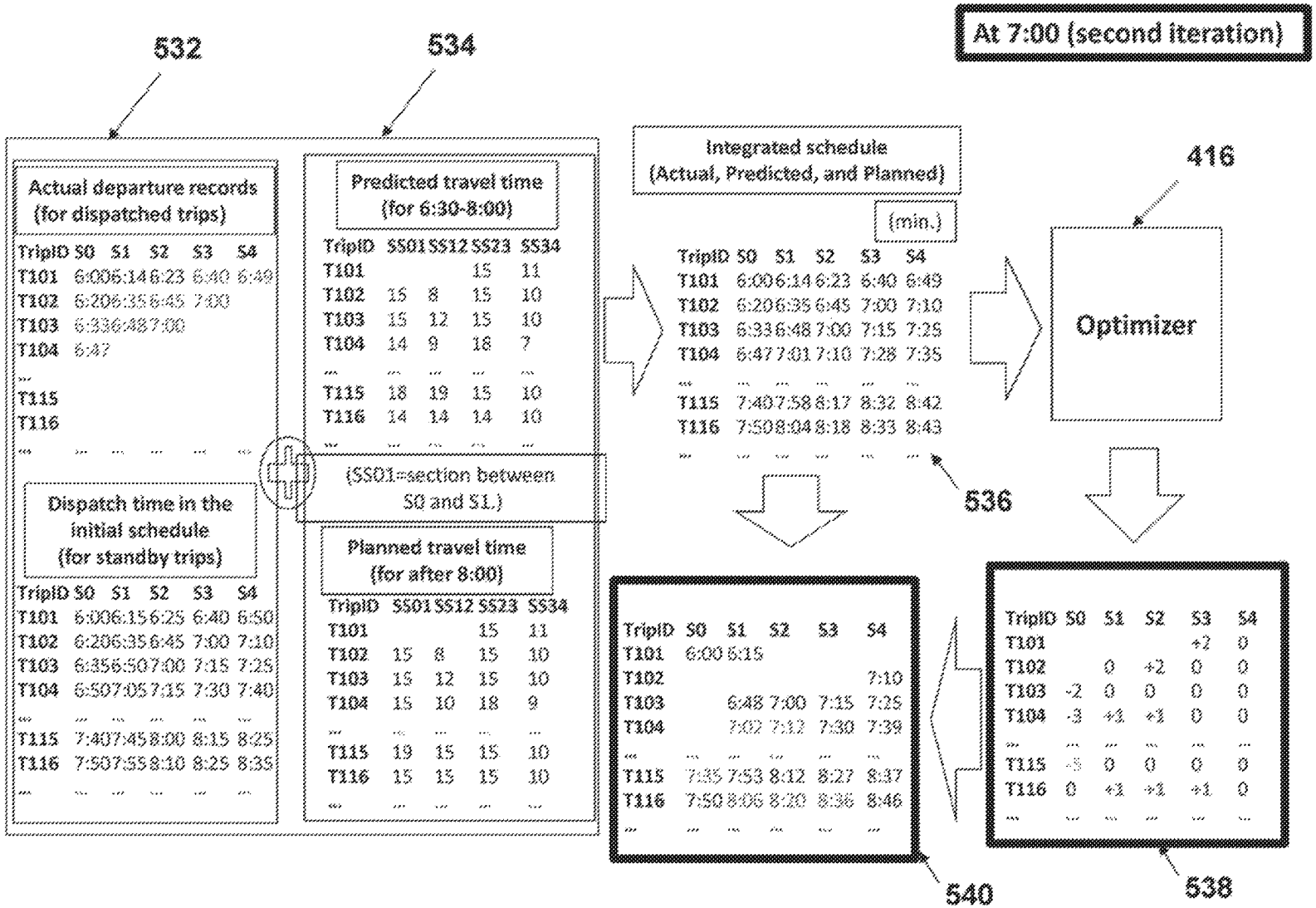

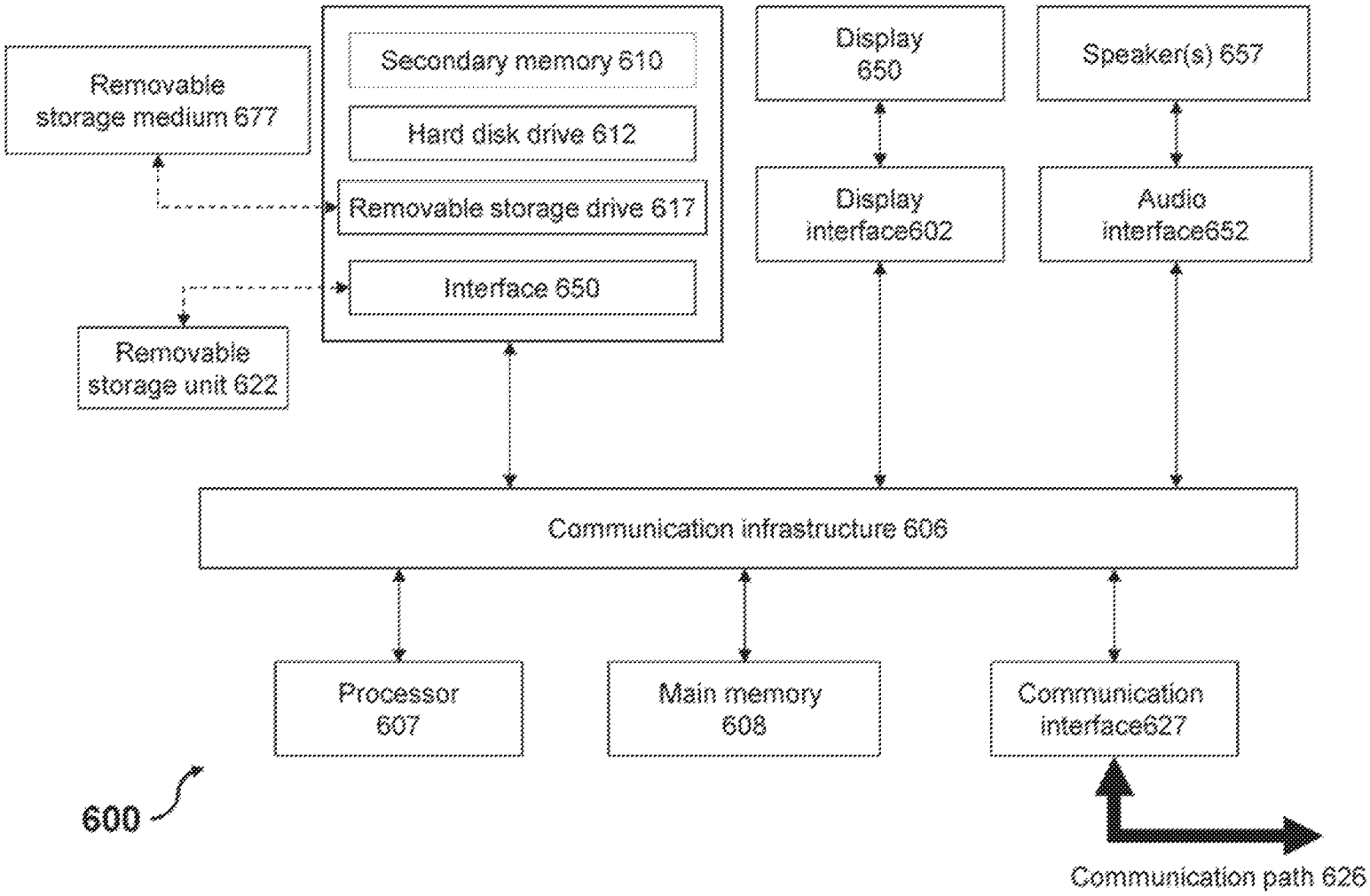
[Fig. 6]

METHOD AND APPARATUS FOR OPTIMIZING EFFICIENCY OF A TRANSPORT PROVIDER

CROSS REFERENCE TO RELATED APPLICATIONS

This application is a National Stage of International Application No. PCT/JP2018/025171 filed Jul. 3, 2018, claiming priority based on Singaporean Patent Application No. 10201705665P filed Jul. 10, 2017, the disclosure of which is incorporated herein in its entirety by reference.

TECHNICAL FIELD

The present invention relates broadly, but not exclusively, to methods for optimizing efficiency of a transport provider.

BACKGROUND ART

With the rapid development of urban transport, road network structure is becoming more complex, increasing delivery traffic. There are many factors affecting the proper and efficient operation of an urban transit system. Some of these factors include infrastructure, the advanced nature of operations management and the corresponding technical means.

Urbanization poses many challenges for providing transportation services in urban area. This includes optimizing efficiency of a transport provider. One such example is the increased difficulty in improving capacity and improving service quality of bus service operators.

There are two possible ways to manage operations of a transport provider, namely, on time adherence against a predefined schedule and managing headway equality between trips. In that regard, schedule optimization technology is a technology that has been applied in the management of urban transit operation. Schedule optimization can be based on real-time traffic information, the initial schedule, and speed data of the vehicles to optimize the efficiency. Parameters that the transport providers are working on to improve are a headway which is a measurement of the distance or time between vehicles in a transit system. The minimum headway is the shortest distance or time achievable by a system without a reduction in the speed of vehicles. Around the world, transport providers aim to optimize efficiency by working towards headway equality between trips.

SUMMARY OF INVENTION

Technical Problem

Currently, conventional techniques improves headway by adopting estimated time arrival (ETA) which focuses on the arrival time of the vehicle at the next location (or station). One problem with this technique is that there are not many options to adjust a plan if it already includes subsequent trips and the transport provider may not have the capacity to avoid potential delays.

In one conventional technique, departure and arrival times for ongoing vehicles and subsequent trips are adjusted in an iterative manner, based on the departure and arrival records that have been obtained up to date. REFLEX is an optimization technology which utilizes Stochastic Annealing (SA) to converge to a stochastic global minimum of the excess waiting times (EWT) function. REFLEX can run iteratively because of its fast optimization with the use of a Sequential Exterior Point Greedy (SEPG) method.

FIG. 1A shows a block diagram of a conventional system 100 utilizing one such conventional technique which collects all departure and arrival times of a vehicle for an entire trip. The departure time refers to one at which the vehicle leaves a location and the arrival time refers to one at which the vehicle arrives at the next successive location. A processor module 110 may be configured to receive initial schedule data from a corresponding database 102, control measures and their required data from a corresponding database 104, and other data from external databases 106 and 108 to generate adjusted data 112. The problem with this technique is that the adjustment may only be carried out with complete departure and arrival time records. However, it often over-fits to current situation, thus worsening the headway equality.

FIG. 1B shows a block diagram of a conventional system 150 utilizing another conventional technique which adjusts departure and arrival times for a vehicle during an on-going trip and subsequent trips. A processor module 136 may be configured to receive initial schedule data from a corresponding database 122, control measures and their required data from a corresponding database 124, and other data from external database 126. The processor module 136 is operationally coupled to a calculation module 134 that is configured to estimate the arrival time of the vehicle at the next location. The calculation module 134 is configured to receive travel speed data 130 to generate an estimated arrival time of the vehicle at the next stop to the processor module 136. One of the problems with this technique is that travel time for a trip is estimated based on a travel time of a previous vehicle; the estimated travel time is only accurate in a short term. That is, it is often difficult or impossible to estimate for a vehicle that is not scheduled to arrive at a location immediately after the previous vehicle. Moreover, the adjustment sometimes becomes too much to improve overall operation if a big delay is estimated in a short-term window (i.e. only for the next bus stop) but the delay will become small in long-term window (i.e. for subsequent bus stops). In other words, the adjustment sometimes makes over-fits to the current situation, not to fit to long-term situation, thus worsening the headway equality.

A need therefore exists to provide methods for optimizing efficiency of a transport provider that addresses one or more of the above problems.

Furthermore, other desirable features and characteristics will become apparent from the subsequent detailed description and the appended claims, taken in conjunction with the accompanying drawings and this background of the disclosure.

Solution to Problem

In a first aspect, a method for optimizing efficiency of a transport provider is provided, comprising: receiving, by a processor, a first departure time of a vehicle, which is administered by the transport provider, at a first location; receiving, by the processor, a second departure time of the vehicle at a second location which is located after the first location; determining, by the processor, a difference between the first departure time and the second departure time; and updating, by the processer, a current schedule to provide an updated schedule in response to the determination of the difference, the updated schedule indicating an updated estimated arrival time of the vehicle at a location after the second location.

In one embodiment, the step of updating the current schedule to provide the updated schedule comprises: updating, by the processor, an estimated first departure time of at least one other vehicle, to provide an updated estimated first departure time, the at least one other vehicle being one which is administered by the transport provider and the estimated first departure time of at least one other vehicle being one at which the at least one other vehicle is expected to depart from the first location. In one embodiment, the method further comprises receiving, by the processor, a first departure time of the at least one other vehicle, the first departure time of the at least one other vehicle being one at which the at least one other vehicle departs from the first location.

In one embodiment, the method further comprises determining, by the processor, a difference between the updated estimated first departure time of the at least one other vehicle and the recorded first departure time of the at least one other vehicle, the difference being a control measure data.

In one embodiment, the current schedule is updated to provide the updated schedule in response to the determination of the control measure data.

In one embodiment, the method further comprises optimizing, by the processor, a headway between the vehicle and the at least one other vehicle in response to the updated schedule.

In one embodiment, the step of optimizing the headway comprises receiving, by the processor, predetermined data relevant to at least the vehicle; and optimizing, by the processor, the headway in response to the step of receiving of the predetermined data.

In one embodiment, the at least one other vehicle is one that is in transit.

In one embodiment, wherein the step of updating the current schedule to provide the updated schedule comprises receiving, by the processor, speed information relating to the vehicle, wherein the current schedule is updated to provide the updated schedule in response to the step of receiving the speed information relating to the vehicle.

In one embodiment, the method further comprises displaying, on a display, the updated schedule.

In another aspect, an apparatus for optimizing efficiency of a transport provider is provided, the apparatus comprising at least one processor; and at least one memory including computer program code; the at least one memory and the computer program code configured to, with at least one processor, cause the apparatus at least to: receive a first departure time of a vehicle which is administered by the transport provider at a first location; receive a second departure time of the vehicle at a second location which is located after the first location; determine a difference between the first departure time and the second departure time; and update a current schedule to provide an updated schedule in response to the determination of the difference, the updated schedule indicating an updated estimated arrival time of the vehicle at a location after the second location.

In one embodiment, the at least one memory and the computer program code is further configured with the at least one processor to: receive a first departure time of the at least one other vehicle, the first departure time of the at least one other vehicle being one at which the at least one other vehicle departs from the first location.

In one embodiment, the at least one memory and the computer program code is further configured with the at least one processor to: determine a difference between the updated estimated first departure time of the at least one other vehicle and the recorded first departure time of the at least one other vehicle, the difference being a control measure data.

In one embodiment, the at least one memory and the computer program code is further configured with the at least one processor to update the current schedule to provide the updated schedule in response to the determination of the control measure data.

In one embodiment, the at least one memory and the computer program code is further configured with the at least one processor to optimize a headway between the vehicle and the at least one other vehicle in response to the updated schedule.

In one embodiment, the at least one memory and the computer program code is further configured with the at least one processor to receive predetermined data relevant to at least the vehicle; and optimize the headway in response to the receipt of the predetermined data.

In one embodiment, the at least one memory and the computer program code is further configured with the at least one processor to receive speed information relating to the vehicle, wherein the current schedule is updated to provide the updated schedule in response to the receipt of the speed information relating to the vehicle.

In one embodiment, wherein the at least one memory and the computer program code is further configured with the at least one processor to display, on a display, the updated schedule.

BRIEF DESCRIPTION OF DRAWINGS

Embodiments of the invention will be better understood and readily apparent to one of ordinary skill in the art from the following written description, by way of example only, and in conjunction with the drawings, in which:

FIG. 1A shows block diagrams of a conventional system within which efficiency of a transport provider is optimized.

FIG. 1B shows block diagrams of a conventional system within which efficiency of a transport provider is optimized.

FIG. 2 shows a block diagram of a system within which efficiency of a transport provider is optimized according to an embodiment.

FIG. 3 shows a flowchart illustrating a method for optimizing efficiency of a transport provider in accordance with embodiments of the invention.

FIG. 4 shows a block diagram of a system within which efficiency of a transport provider is optimized in accordance with embodiments of the invention.

FIG. 5A shows an example as to how efficiency of a transport provider is optimized in accordance with embodiments of the present inventions.

FIG. 5B shows the parameters that are used in optimizing efficiency of the transport provider.

FIG. 5C shows an example where there are vehicles 504, 506 in transit and at least one vehicle 508 that is parked.

FIG. 5D shows how an efficiency of a transport provider may be optimized using the system.

FIG. 5E shows how an efficiency of a transport provider may be optimized using the system.

FIG. 5F shows how an efficiency of a transport provider may be optimized using the system.

FIG. 5G shows how departure times may be predicted while optimizing efficiency of the transport provider.

FIG. 5H shows how the settings and steps described in the earlier steps are used to optimize the headway between trips.

FIG. 5I shows how adjusted departure time 528 may be created from actual departure records/expected dispatch times 522 and predicted travel time/planned travel time 524.

FIG. 5J shows how various results may be displayed to at least a user.

FIG. 5K shows a second iteration relating to how the efficiency is optimized for the transport provider.

FIG. 5L shows how departure times are predicted in the second iteration.

FIG. 5M shows how departure times are adjusted in order to optimize efficiency for the transport provider at the second iteration.

FIG. 6 shows an exemplary computing device that may be used to execute the method of FIG. 3.

DESCRIPTION OF EMBODIMENTS

Embodiments of the present invention will be described, by way of example only, with reference to the drawings. Like reference numerals and characters in the drawings refer to like elements or equivalents.

Some portions of the description which follows are explicitly or implicitly presented in terms of algorithms and functional or symbolic representations of operations on data within a computer memory. These algorithmic descriptions and functional or symbolic representations are the means used by those skilled in the data processing arts to convey most effectively the substance of their work to others skilled in the art. An algorithm is here, and generally, conceived to be a self-consistent sequence of steps leading to a desired result. The steps are those requiring physical manipulations of physical quantities, such as electrical, magnetic or optical signals capable of being stored, transferred, combined, compared, and otherwise manipulated.

Unless specifically stated otherwise, and as apparent from the following, it will be appreciated that throughout the present specification, discussions utilizing terms such as "receiving", "calculating", "determining", "updating", "generating", "initializing", "outputting", "receiving", "retrieving", "identifying", "dispersing", "authenticating" or the like, refer to the action and processes of a computer system, or similar electronic device, that manipulates and transforms data represented as physical quantities within the computer system into other data similarly represented as physical quantities within the computer system or other information storage, transmission or display devices.

The present specification also discloses apparatus for performing the operations of the methods. Such apparatus may be specially constructed for the required purposes, or may comprise a computer or other device selectively activated or reconfigured by a computer program stored in the computer. The algorithms and displays presented herein are not inherently related to any particular computer or other apparatus. Various machines may be used with programs in accordance with the teachings herein. Alternatively, the construction of more specialized apparatus to perform the required method steps may be appropriate. The structure of a computer will appear from the description below.

In addition, the present specification also implicitly discloses a computer program, in that it would be apparent to the person skilled in the art that the individual steps of the method described herein may be put into effect by computer code. The computer program is not intended to be limited to any particular programming language and implementation thereof. It will be appreciated that a variety of programming languages and coding thereof may be used to implement the teachings of the disclosure contained herein. Moreover, the computer program is not intended to be limited to any particular control flow. There are many other variants of the computer program, which can use different control flows without departing from the spirit or scope of the invention.

Furthermore, one or more of the steps of the computer program may be performed in parallel rather than sequentially. Such a computer program may be stored on any computer readable medium. The computer readable medium may include storage devices such as magnetic or optical disks, memory chips, or other storage devices suitable for interfacing with a computer. The computer readable medium may also include a hard-wired medium such as exemplified in the Internet system, or wireless medium such as exemplified in the GSM mobile telephone system. The computer program when loaded and executed on such a computer effectively results in an apparatus that implements the steps of the preferred method.

Various embodiments of the present invention relate to methods and apparatuses for optimizing efficiency of a transport provider. In an embodiment, the method and apparatus update a current schedule to provide an updated schedule based on the departure times of the vehicle at the first location and the second location which is after the first location.

FIG. 2 shows a block diagrams of a system 200 within which efficiency of a transport provider is optimized according to an embodiment.

Referring to FIG. 2, provision of the optimization process involves an apparatus 202 that is operationally coupled to at least one sensor 210. Each sensor 210 is configured to record and send at least a departure time of a vehicle at a location. The sensor 210 may be, among other things, include an image capturing device and a motion sensor. The apparatus 202 is configured to receive the departure time of the vehicle.

The sensor 210 is capable of wireless communication using a suitable protocol with the apparatus 202. For example, embodiments may be implemented using sensors 210 that are capable of communicating with WiFi/Bluetooth-enabled apparatus 202. It will be appreciated by a person skilled in the art that depending on the wireless communication protocol used, appropriate handshaking procedures may need to be carried out to establish communication between the sensor 210 and the apparatus 202. For example, in the case of Bluetooth communication, discovery and pairing of the sensor 210 and the apparatus 202 may be carried out to establish communication.

In an example, a departure time is recorded (or detected) at the sensor 210 when the vehicle (e.g., a bus) leaves a first location (e.g., a bus stop). The departure time (or a first departure time) may be recorded in response of the vehicle leaving the first location. In other words, the departure time relates to the beginning of a time period of the vehicle leaving the first location and making its way to the second location (or a successive location after the first location). When the vehicle arrives at the second location, the arrival time may be detected at another sensor 210 located at the second location. The arrival time may be recorded in response of the vehicle arriving at the second location. In other words, the arrival time relates to the end of the time period which begins with the vehicle leaving the first location. The time period between the first departure time and the arrival time at the second location is also known as a transit time. The sensor 210 at the second location is configured to record a departure time at which the vehicle leaves the second location. The period during which the vehicle stays at the second location is a dwell time. The dwell time represents a period during which the vehicle stays at a location and can be determined based on the arrival time and the departure of the vehicle at that location.

The apparatus 202 may include a processor 204 and a memory 206. In embodiments of the invention, the memory 206 and the computer program code, with processor 204, are configured to cause the apparatus 202 to receive a first departure time of a vehicle which is administered by the transport provider at a first location; receive a second departure time of the vehicle at a second location which is located after the first location; determine a difference between the first departure time and the second departure time; and update a current schedule to provide an updated schedule in response to the determination of the difference, the updated schedule indicating an updated estimated arrival time of the vehicle at a location after the second location.

The apparatus 202 may be a server (e.g. a headway optimizing server 416 in FIG. 4 below). In embodiments of the present invention, use of the term 'server' may mean a single computing device or at least a computer network of interconnected computing devices which operate together to perform a particular function. In other words, the server may be contained within a single hardware unit or be distributed among several or many different hardware units.

Such a server may be used to implement the method 300 shown in FIG. 3. FIG. 3 shows a flowchart illustrating a method 300 for optimizing efficiency of a transport provider in accordance with embodiments of the invention.

High frequency bus operations in metropolitan areas are expected to provide a reliable service to passengers by reducing their excess waiting time (EWTs) at bus stations. In several metropolis, such as London and Singapore, bus operators receive monetary incentives if they manage to reduce the EWTs of passengers or penalties if they fail to do so. However, optimizing the regularity of bus operations by preventing bus bunching is a computationally intractable problem and bus operators are not able to schedule the daily bus trips in an optimal way. Therefore, transport providers (or bus operators) rely on in-house expertise to manage their operations without fully exploiting the potential of applying operational control measures such as dispatching and bus holding at stations. Embodiments of the present invention allow one to set a prediction window and manage headway by updating a plan of subsequent trips in advance.

Thus, embodiments of the present invention can advantageously optimize efficiency of a transport provider by equalizing headway of the vehicle as it travels between two locations. This is made possible because various embodiments determine a more accurate headway by considering the dwell time of the vehicle at a location. In stark contrast, conventional techniques only consider the transit time (e.g., the departure time at the first location and the arrival time at the second location).

The method 300 broadly includes:

step 302: receiving, by a processor, a first departure time of a vehicle which is administered by the transport provider at a first location step 304: receiving, by the processor, a second departure time of the vehicle at a second location which is located after the first location step 306: determining, by the processor, a difference between the first departure time and the second departure time step 308: updating, by the processer, a current schedule to provide an updated schedule in response to the determination of the difference, the updated schedule indicating an updated estimated arrival time of the vehicle at a location after the second location.

At step 308, the method 300 for optimizing efficiency of a transport provider includes updating an estimated first departure time of at least one other vehicle which is also administered by the transport provider. The estimated first departure time of the at least one other vehicle being one at which the at least one other vehicle is expected to depart from the first location. This may be included in the current schedule. In the following description, as the efficiency of the transport provider is being optimized within a window of prediction, the schedule that is up-to-date will be referred to as "current schedule" (including an initial schedule indicating when the vehicles may be expected at each location), which is meant to be differentiated from "updated schedule" which includes adjustments to the current schedule.

The updated estimated first departure time is one that takes into consideration of the difference between the first departure time and the second departure time in step 306. In various embodiments, the at least one vehicle is one that is in transit or is scheduled to travel behind the vehicle mentioned in step 302 to step 306. As such, if the target vehicle is expected to take a longer than the initial estimation, the vehicle or vehicles behind the target vehicle can be expected to arrive later too.

Further, at step 308, the method 300 for optimizing efficiency of a transport provider further includes receiving speed information relating to the vehicle and the current schedule is updated to provide the updated schedule in response to the step of receiving the speed information relating to the vehicle.

The method 300 may further comprise receiving an actual first departure time of the at least one other vehicle. The received first departure time of the at least one other vehicle is one at which the at least one other vehicle departs from the first location. In response to receiving the first departure time of the at least one other vehicle, the method may further comprise determining, a difference between the updated estimated first departure time of the at least one other vehicle and the recorded first departure time of the at least one other vehicle, the difference being a control measure data. The current schedule is updated to provide the updated schedule in response to the determination of the control measure data. At least one of the current schedule and the update schedule may be displayed on a display.

The method 300 may further comprise optimizing a headway between the vehicle and the at least one other vehicle in response to the updated schedule. The step of optimizing the headway may comprise receiving predetermined data relevant to at least the vehicle and optimizing the headway in response to the step of receiving of the predetermined data. The predetermined data may include the travel speed of the vehicle. Alternatively, the predetermined data may be data that relates to the vehicle. For example, it may include the amount of time that a driver, who is responsible for the vehicle, typically takes for a meal. In one embodiment, the at least one other vehicle is one that is in transit. Alternatively, the predetermined data includes external parameters relevant to the vehicle. For example, a location (or a bus stop) may be more crowded during peak hours if it is located outside a commercial building or offices. Similarly, a location (or a bus stop) may be more crowded before or after school hours if it is located outside a school. Additionally, the at least one other vehicle is one that is stationary but scheduled to take the same route as the vehicle in step 302 to step 308.

FIG. 4 shows a schematic diagram of a system 400 implemented in accordance with embodiments of the invention. The system includes a headway optimizing server 416 which is operationally coupled to a travel time prediction server 414, a sensor 408 and a transmitter 410 for transmitting other data relevant to a vehicle.

The headway optimizing server 416 typically is associated with a transport provider or a party who is optimizing efficiency of a target transport provider. A transport provider may be an entity (e.g. a company or organization) which administers (e.g. manages) a vehicle (e.g. a bus). As stated in the above, the headway optimizing server 416 may include one or more computing devices that are used to establish communication with another server by exchanging messages with and/or passing information to another device (e.g, a sensor).

The headway optimizing server 416 may be configured to retrieve information from the databases 402, 404 and 406. Additionally or alternatively, the headway optimizing server 416 may be configured to receive departure records from a corresponding sensor 408 and other predetermined data from a corresponding sensor 410. In an embodiment, the headway optimizing server 416 is configured to retrieve an initial schedule data from a corresponding database 402, control measures and their corresponding time data from a corresponding database 404 and constrain data from a corresponding database 406. Also, the headway optimizing server 416 is configured to receive an output that is tabulated by the travel time prediction server 414. The headway optimizing server 416 may be configured to output an adjusted schedule (including adjusted departure times) which may be stored in a corresponding database 420 and/or control measure data which may be stored in a corresponding database 418. The outputs generated by the headway optimizing server 416 may be received by the headway optimizing server 416 as inputs.

The travel prediction server 414 is one that is configured to output a travel time prediction for a vehicle in response to receiving departure records from the corresponding sensor 408, other predetermined data from the corresponding sensor 410 and other travel time prediction model from a corresponding database 412. The database 412 may include mathematical models or statistical models that are suitable for prediction. The output from the travel prediction server 414 may be displayed on a display and/or send to the headway optimizing server 416

FIGS. 5A-5M show an example as to how efficiency of a transport provider is optimized in accordance with embodiments of the present invention. FIG. 5A shows that there are a series of successive locations (or bus stops), beginning from the first location S0, then the second location S1 which is located after the first location S0. The third location S2 is located after S1 and the fourth location S3 is located after S2. Similarly, the fifth location S4 is located after S3. S3 may be determined as an assessment point for evaluating excess waiting time (EWT). The determination of S3 as the assessment point may be done by a government. In FIG. 5A, an initial schedule (or current schedule) 502 may be available showing the expected time of arrival of each vehicle (or bus) at each location. For example, for the first vehicle (e.g., 504 in FIG. 5C), having a trip ID of T101, is expected to arrive at S0 at 6:00 am, at S1 at 6:15 am, at S2 at 6:25 am, at S3 at 6:40 am and at S4 at 6:50 am. In the following description, it will be shown how embodiments allow a transport provider to manage its operations, including dispatching and holding buses at various stations so as to manage headway for a plurality of planned trips within a prediction window. For vehicles that are in transit and are still parked (i.e., not yet in transit), long term travel time prediction technique may be adopted to derive the initial schedule 502.

FIG. 5B shows the parameters that are used in optimizing efficiency of the transport provider. For example, between S0 and S1, there are two periods of time, namely transit time (e.g., TT01) and dwell time (e.g., DT1). For the purposes of optimizing efficiency of the transport provider according to various embodiments, a travel time (e.g., SS01) taken by the vehicle from S0 to S1 is taken to include TT01 and DT1. In other words, the travel time of a vehicle between two successive locations is a combination of the transit time and the dwell time.

FIG. 5C shows an example where there are vehicles 504, 506 in transit and at least one vehicle 508 that is parked (e.g., standby or not yet in transit). As mentioned above, embodiments of the invention allow one to set a prediction window and manage headway by updating a schedule for a plurality of trips (for vehicles that are both in transit or on standby) in an optimal way.

For the purposes of optimizing efficiency, the targets for predictions are those that the vehicles (both in transit or on standby) will be approaching. This includes SS23 and SS34 for the vehicle on Trip 1; SS01, SS12, SS23 and SS34 for the vehicle on Trip 2 and SS01, SS12, SS23 and SS34 for the vehicle scheduled on Trip 3.

FIGS. 5D-5F show how an efficiency of a transport provider may be optimized using the system shown in FIG. 4. FIG. 5D shows how settings may be set for the purpose of optimizing efficiency of the transport provider. The initial schedule 512 may be retrieved from the database 402. The relevant control measures and their required time 514 may be inputted to the database 404. This includes the locations that are relevant (e.g., S0, S3). Constrains data may also be inputted into database 406. Constrain data 516 include, among other things, the maximum time that each vehicle may leave a specific location earlier (e.g., 5 minutes) and the meal time required by the driver driving the vehicle (e.g., 20 minutes). The general setting 510 for the process may also be set, e.g., an optimization frequency of 30 minutes and a time period for prediction of 90 minutes.

FIG. 5E shows a first step in a first iteration in optimizing efficiency of the transport provider. The actual departure time records 518 for vehicles 504 and 506 may be retrieved. At the first iteration, for example, at 6:30 am, the vehicle 504 on Trip T101 is in the midst of the transit time between S2 and S3, after the vehicle 504 has departed at S2 at 6:23 am, which is two minutes earlier than the initial schedule 512. Also, at 6:30 am, the vehicle 506 on Trip T102 is in the midst of the transit time between S0 and S1, after the vehicle 506 has departed at S0 at 6:20 am, which is the exact time in the initial schedule 512.

FIG. 5F shows a second step in the first iteration in optimizing efficiency of the transport provider. One of the settings is having a time period for prediction of 90 minutes. As such, in FIG. 5F, a predicted schedule table 520 is created based on a predicted travel time as an output from travel prediction server 414, actual departure records 408, and the initial schedule 512.

FIG. 5G shows how departure times may be predicted while optimizing efficiency of the transport provider. First, actual departure records 522 for vehicles 504 (having a trip ID, T101), 506 (having a trip ID, T102) that have been dispatched (e.g., in transit) and the initial dispatch times 522 for vehicles (e.g., 508, having a trip ID, T103) that are on standby (e.g., parked) are retrieved. Next, the predicted time required for the vehicle to travel (e.g., transit time) between two consecutive locations (e.g, from S3 to S4) is retrieved for locations of interest as the output of the travel prediction server 414. The predicted transit time 524 is added to the records retrieved in the first step to obtain predicted departure time 526 (or 520 as shown in FIG. 5F) for the next 90 minutes.

FIG. 5H shows how the settings and steps described in the earlier steps are used to optimize the headway between trips. Control measures are outputs of the headway optimizing server 416. Examples of the control measures include, among other things, a difference between a predicted departure time and an initial departure time. As mentioned in the above, EWT methodology is one measure of perceived regularity of a transport provider. That is, EWT methodology measures the average additional waiting time passengers experience as compared with the waiting time they expect. In order to manage the additional waiting time a passenger may experience at a location, control measures are parameters that are output from the headway optimizing server 416 to adaptively manage the headway.

In an embodiment, for determining control measures shown in 530, REFLEX, which is the optimization engine for bus operation may be adopted. Conventionally, optimizing headway equalization is difficult to carry out because of the amount of data to process. It is technically impossible to search all cases of combinations (e.g. how many minutes to adjust for each location for each trip), because of the large number of cases. REFLEX is the technology to find an optimum set of control measures for over a period of time (e.g., days) in short time.

In an example, some optimization steps in REFLEX include:

Step 1. find the optimum set of adjustment on only dispatch time for all trips, in terms of headway equality on S3.

Step 2. find the optimum set of adjustment on only bus holding time at bus stop for all trips, in terms of headway equality on S3.

FIG. 5I shows how adjusted departure time 528 may be created from actual departure records/expected dispatch times 522 and predicted travel time/planned travel time 524. First, the actual departure records 522 for vehicles 504, 506 that have been dispatched and the expected dispatch times for vehicles 508 on standby are retrieved. Next, the predicted travel time 518 to travel to the locations of interest within the window of time for prediction (e.g., 90 minutes) is added to the actual departure times and the expected dispatch times to get an updated schedule (or integrated schedule). The control measures 530 are calculated and are used to get adjusted departure times by the headway optimizing server 416. In an example, the initial schedule 512 and the control measures 530 are used to generate the adjusted departure time 528.

FIG. 5J shows how various results may be displayed to at least a user. In an embodiment, at least one of control measures 530, adjusted departure time 528 and predicted departure time 518 may be made available to at least a user, e.g., a member of the transport provider who manages and controls operational quality. By visualizing these parameters make it possible for a user to know when a vehicle can be expected, not just the immediate vehicle but any vehicle that will arrive at the location within the window of prediction. Also, it makes it possible for a user knows the best timetable for EWT, by taking into account the prediction of travel time within 90 min. Conventionally, a user is only able to know the estimated time of arrival of the immediate next vehicle at a specific location and adjust the timetable based on the estimated time of arrival.

FIG. 5K shows a second iteration relating to how the efficiency is optimized for the transport provider. The settings for the second iteration include an optimization frequency of 30 minutes and the first iteration was at 6:30 am shown in 510. At the second iteration which was 7:00 am, the process of optimizing the efficiency is iterated. That is, the current statuses 518 of the vehicles are collected again and the headway equality is optimized for subsequent trips.

FIG. 5L shows how departure times are predicted in the second iteration. In an embodiment, the time window for predictions is set as 90 minutes for the second iteration. First, actual departure records 532 for vehicles and dispatch time 532 for vehicles that are scheduled to dispatch at 7 am are retrieved. Next, the predicted travel time 534 to travel to locations of interest within the window for prediction are obtained and added to the actual departure records for vehicles and dispatch time for vehicles that are scheduled to dispatch at 7 am so as to obtain the predicted departure time 536.

FIG. 5M shows how departure times are adjusted in order to optimize efficiency for the transport provider at the second iteration. As mentioned in the above, EWT is a difference between the scheduled wait time and the actual wait time as recorded at various points along the route. It is important to deliver regularity by maintaining headway equality between trips. However, as mentioned earlier in the above, there are constrains on how much earlier a transport provider may dispatch a bus. For example, the earliest that the transport provider may dispatch a bus is 5 minutes before its scheduled departure time. That is, if the ideal adjustment for vehicle having trip ID, T115, is 7 minutes (or "−7") before its scheduled time, it is not possible to do so since it contradicts with the constrain data of dispatching the vehicle 5 minutes (or "−5") before its scheduled time. Hence, in the table of control measures as shown in 538, the adjustment for T115 at station S0 is −5. In order to maintain headway equality, the trips before and after T115, which are T114 and 116, may be adjusted accordingly to compensate the expected increase of EWT caused by T115 not being able to leave 7 minutes earlier from station S0.

FIG. 6 depicts an exemplary computing device 600, hereinafter interchangeably referred to as a computer system 600, where one or more such computing devices 600 may be used to execute the method of FIG. 3. The exemplary computing device 600 can be used to implement the system 200, 400 shown in FIGS. 2 and 4. The following description of the computing device 600 is provided by way of example only and is not intended to be limiting.

As shown in FIG. 6, the example computing device 600 includes a processor 607 for executing software routines. Although a single processor is shown for the sake of clarity, the computing device 600 may also include a multi-processor system. The processor 607 is connected to a communication infrastructure 606 for communication with other components of the computing device 600. The communication infrastructure 606 may include, for example, a communications bus, cross-bar, or network.

The computing device 600 further includes a main memory 608, such as a random access memory (RAM), and a secondary memory 610. The secondary memory 610 may include, for example, a storage drive 612, which may be a hard disk drive, a solid state drive or a hybrid drive and/or a removable storage drive 617, which may include a magnetic tape drive, an optical disk drive, a solid state storage drive (such as a USB flash drive, a flash memory device, a solid state drive or a memory card), or the like. The removable storage drive 617 reads from and/or writes to a removable storage medium 677 in a well-known manner. The removable storage medium 677 may include magnetic tape, optical disk, non-volatile memory storage medium, or the like, which is read by and written to by removable storage drive 617. As will be appreciated by persons skilled in the relevant art(s), the removable storage medium 677 includes a computer readable storage medium having stored therein computer executable program code instructions and/or data.

In an alternative implementation, the secondary memory 610 may additionally or alternatively include other similar means for allowing computer programs or other instructions to be loaded into the computing device 600. Such means can include, for example, a removable storage unit 622 and an interface 650. Examples of a removable storage unit 622 and interface 650 include a program cartridge and cartridge interface (such as that found in video game console devices), a removable memory chip (such as an EPROM or PROM) and associated socket, a removable solid state storage drive (such as a USB flash drive, a flash memory device, a solid state drive or a memory card), and other removable storage units 622 and interfaces 650 which allow software and data to be transferred from the removable storage unit 622 to the computer system 600.

The computing device 600 also includes at least one communication interface 627. The communication interface 627 allows software and data to be transferred between computing device 600 and external devices via a communication path 627. In various embodiments of the inventions, the communication interface 627 permits data to be transferred between the computing device 600 and a data communication network, such as a public data or private data communication network. The communication interface 627 may be used to exchange data between different computing devices 600 which such computing devices 600 form part an interconnected computer network. Examples of a communication interface 627 can include a modem, a network interface (such as an Ethernet card), a communication port (such as a serial, parallel, printer, GPIB, IEEE 1394, RJ45, USB), an antenna with associated circuitry and the like. The communication interface 627 may be wired or may be wireless. Software and data transferred via the communication interface 627 are in the form of signals which can be electronic, electromagnetic, optical or other signals capable of being received by communication interface 627. These signals are provided to the communication interface via the communication path 627.

As shown in FIG. 6, the computing device 600 further includes a display interface 602 which performs operations for rendering images to an associated display 650 and an audio interface 652 for performing operations for playing audio content via associated speaker(s) 657.

As used herein, the term "computer program product" may refer, in part, to removable storage medium 677, removable storage unit 622, a hard disk installed in storage drive 612, or a carrier wave carrying software over communication path 627 (wireless link or cable) to communication interface 627. Computer readable storage media refers to any non-transitory, non-volatile tangible storage medium that provides recorded instructions and/or data to the computing device 600 for execution and/or processing. Examples of such storage media include magnetic tape, CD-ROM, DVD, Blu-ray™ Disc, a hard disk drive, a ROM or integrated circuit, a solid state storage drive (such as a USB flash drive, a flash memory device, a solid state drive or a memory card), a hybrid drive, a magneto-optical disk, or a computer readable card such as a PCMCIA card and the like, whether or not such devices are internal or external of the computing device 600. Examples of transitory or non-tangible computer readable transmission media that may also participate in the provision of software, application programs, instructions and/or data to the computing device 600 include radio or infra-red transmission channels as well as a network connection to another computer or networked device, and the Internet or Intranets including e-mail transmissions and information recorded on Websites and the like.

The computer programs (also called computer program code) are stored in main memory 608 and/or secondary memory 610. Computer programs can also be received via the communication interface 627. Such computer programs, when executed, enable the computing device 600 to perform one or more features of embodiments discussed herein. In various embodiments, the computer programs, when executed, enable the processor 607 to perform features of the above-described embodiments. Accordingly, such computer programs represent controllers of the computer system 600.

Software may be stored in a computer program product and loaded into the computing device 600 using the removable storage drive 617, the storage drive 612, or the interface 650. The computer program product may be a non-transitory computer readable medium. Alternatively, the computer program product may be downloaded to the computer system 600 over the communications path 627. The software, when executed by the processor 607, causes the computing device 600 to perform the necessary operations to execute the method 300 as shown in FIG. 3.

It is to be understood that the embodiment of FIG. 6 is presented merely by way of example to explain the operation and structure of the system 200 or 400. Therefore, in some embodiments one or more features of the computing device 600 may be omitted. Also, in some embodiments, one or more features of the computing device 600 may be combined together. Additionally, in some embodiments, one or more features of the computing device 600 may be split into one or more component parts.

It will be appreciated that the elements illustrated in FIG. 6 function to provide means for performing the various functions and operations of the servers as described in the above embodiments.

When the computing device 600 is configured to optimize efficiency of a transport provider, the computing system 600 will have a non-transitory computer readable medium having stored thereon an application which when executed causes the computing system 600. To perform steps comprising: receive a first departure time of a vehicle which is administered by the transport provider at a first location; receive a second departure time of the vehicle at a second location which is located after the first location; determine a difference between the first departure time and the second departure time; and update a current schedule to provide an updated schedule in response to the determination of the difference, the updated schedule indicating an updated estimated arrival time of the vehicle at a location after the second location.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

For example, the whole or part of the exemplary embodiments disclosed above can be described as, but not limited to, the following supplementary notes.

(Supplementary Note 1)

A method for optimizing efficiency of a transport provider, comprising:

receiving, by a processor, a first departure time of a vehicle, which is administered by the transport provider, at a first location;

receiving, by the processor, a second departure time of the vehicle at a second location which is located after the first location;

determining, by the processor, a difference between the first departure time and the second departure time; and updating, by the processer, a current schedule to provide an updated schedule in response to the determination of the difference, the updated schedule indicating an updated estimated arrival time of the vehicle at a location after the second location.

(Supplementary Note 2)

The method according to note 1, wherein the step of updating the current schedule to provide the updated schedule comprises:

updating, by the processor, an estimated first departure time of at least one other vehicle, to provide an updated estimated first departure time, the at least one other vehicle being one which is administered by the transport provider and the estimated first departure time of at least one other vehicle being one at which the at least one other vehicle is expected to depart from the first location.

(Supplementary Note 3)

The method according to note 2, further comprising:

receiving, by the processor, a first departure time of the at least one other vehicle, the first departure time of the at least one other vehicle being one at which the at least one other vehicle departs from the first location.

(Supplementary Note 4)

The method according to note 3, further comprising:

determining, by the processor, a difference between the updated estimated first departure time of the at least one other vehicle and the recorded first departure time of the at least one other vehicle, the difference being a control measure data.

(Supplementary Note 5)

The method according to note 4, wherein the current schedule is updated to provide the updated schedule in response to the determination of the control measure data.

(Supplementary Note 6)

The method according to note 5, further comprising optimizing, by the processor, a headway between the vehicle and the at least one other vehicle in response to the updated schedule.

(Supplementary Note 7)

The method according to note 6, wherein the step of optimizing the headway comprises:

receiving, by the processor, predetermined data relevant to at least the vehicle; and optimizing, by the processor, the headway in response to the step of receiving of the predetermined data.

(Supplementary Note 8)

The method according to any one of notes 2 to 7, wherein the at least one other vehicle is one that is in transit.

(Supplementary Note 9)

The method according to any one of notes 1 to 8, wherein the step of updating the current schedule to provide the updated schedule comprises:

receiving, by the processor, speed information relating to the vehicle, wherein the current schedule is updated to provide the updated schedule in response to the step of receiving the speed information relating to the vehicle.

(Supplementary Note 10)

The method according to any one of notes 1 to 9, further comprising:

displaying, on a display, the updated schedule.

(Supplementary Note 11)

An apparatus for optimizing efficiency of a transport provider, the apparatus comprising:

at least one processor; and at least one memory including computer program code;

the at least one memory and the computer program code configured to, with at least one processor, cause the apparatus at least to:

receive a first departure time of a vehicle which is administered by the transport provider at a first location;

receive a second departure time of the vehicle at a second location which is located after the first location;

determine a difference between the first departure time and the second departure time; and update a current schedule to provide an updated schedule in response to the determination of the difference, the updated schedule indicating an updated estimated arrival time of the vehicle at a location after the second location.

(Supplementary Note 12)

The apparatus according to note 11, wherein the at least one memory and the computer program code is further configured with the at least one processor to:

update an estimated first departure time of at least one other vehicle, to provide an updated estimated first departure time, the at least one other vehicle being one which is administered by the transport provider and the estimated first departure time of at least one other vehicle being one at which the at least one other vehicle is expected to depart from the first location.

(Supplementary Note 13)

The apparatus according to note 12, wherein the at least one memory and the computer program code is further configured with the at least one processor to:

receive a first departure time of the at least one other vehicle, the first departure time of the at least one other vehicle being one at which the at least one other vehicle departs from the first location.

(Supplementary Note 14)

The apparatus according to note 13, wherein the at least one memory and the computer program code is further configured with the at least one processor to:

determine a difference between the updated estimated first departure time of the at least one other vehicle and the recorded first departure time of the at least one other vehicle, the difference being a control measure data.

(Supplementary Note 15)

The apparatus according to note 14, wherein the at least one memory and the computer program code is further configured with the at least one processor to:

update the current schedule to provide the updated schedule in response to the determination of the control measure data.

(Supplementary Note 16)

The apparatus according to note 15, wherein the at least one memory and the computer program code is further configured with the at least one processor to:

optimize a headway between the vehicle and the at least one other vehicle in response to the updated schedule.

(Supplementary Note 17)

The apparatus according to note 16, wherein the at least one memory and the computer program code is further configured with the at least one processor to:

receive predetermined data relevant to at least the vehicle; and optimize the headway in response to the receipt of the predetermined data.

(Supplementary Note 18)

The apparatus according to any one of notes 12-17, wherein the at least one other vehicle is one that is in transit.

(Supplementary Note 19)

The apparatus according to any one of notes 11-18, wherein the at least one memory and the computer program code is further configured with the at least one processor to:

receive speed information relating to the vehicle, wherein the current schedule is updated to provide the updated schedule in response to the receipt of the speed information relating to the vehicle.

(Supplementary Note 20)

The apparatus according to any one of notes 11-19, wherein the at least one memory and the computer program code is further configured with the at least one processor to:

display, on a display, the updated schedule.

REFERENCE SIGNS LIST

402,404,406,412,418,420 database
408,410 sensor
414 prediction server
416 optimizing server
510 general setting
512 schedule
514 required time
516 constrain data
518 time records
520 schedule table
522 dispatch times
524 predicted transit time
526 predicted departure time
528 adjusted departure time
530 control measures
532 departure records
534 predicted travel time
536 predicted departure time
538 control measures

The invention claimed is:

1. A method for optimizing efficiency of a transport provider, comprising:

receiving, by a processor, a first departure time of a vehicle, which is administered by the transport provider, at a first location;

receiving, by the processor, a second departure time of the vehicle at a second location which is located after the first location;

determining, by the processor, a difference between the first departure time and the second departure time; and updating, by the processor, a current schedule to provide an updated schedule for a plurality of trips in response to the determination of the difference, the updated schedule indicating an updated estimated arrival time of the vehicle at a location after the second location;

wherein the updating the current schedule to provide the updated schedule comprises:

updating, by the processor, an estimated first departure time of at least one other vehicle, to provide an updated estimated first departure time to the transport provider based on the difference, the at least one other vehicle being one which is administered by the transport provider and the estimated first departure time of at least one other vehicle being one at which the at least one other vehicle is expected to depart from the first location, and the updated estimated first departure time is within a set prediction window, wherein the at least one other vehicle is one that is in transit, and displaying, on a display, the updated schedule for trips included in the plurality of trips and the estimated first departure time of at least one other vehicle to the transport provider at a location, wherein the trips will arrive at the location within the prediction window.

2. The method according to claim 1, further comprising: receiving, by the processor, a first departure time of the at least one other vehicle, the first departure time of the at least one other vehicle being one at which the at least one other vehicle departs from the first location.

3. The method according to claim 2, further comprising:

determining, by the processor, a difference between the updated estimated first departure time of the at least one other vehicle and the recorded first departure time of the at least one other vehicle, the difference being a control measure data.

4. The method according to claim 3, wherein the current schedule is updated to provide the updated schedule in response to the determination of the control measure data.

5. The method according to claim 4, further comprising optimizing, by the processor, a headway between the vehicle and the at least one other vehicle in response to the updated schedule.

6. The method according to claim 5, wherein the optimizing the headway comprises:

receiving, by the processor, predetermined data relevant to at least the vehicle; and optimizing, by the processor, the headway in response to the step of receiving of the predetermined data.

7. The method according to claim 1, wherein the updating the current schedule to provide the updated schedule comprises:

receiving, by the processor, speed information relating to the vehicle, wherein the current schedule is updated to provide the updated schedule in response to the step of receiving the speed information relating to the vehicle.

8. The method according to claim 3, further comprising: displaying, on the display, the control measure data.

9. An apparatus for optimizing efficiency of a transport provider, the apparatus comprising:

at least one processor; and at least one memory including computer program code;

the at least one memory and the computer program code configured to, with at least one processor, cause the apparatus at least to:

receive a first departure time of a vehicle which is administered by the transport provider at a first location;

receive a second departure time of the vehicle at a second location which is located after the first location;

determine a difference between the first departure time and the second departure time; and update a current schedule to provide an updated schedule for a plurality of trips in response to the determination of the difference, the updated schedule indicating an updated estimated arrival time of the vehicle at a location after the second location;

wherein the updating the current schedule to provide the updated schedule comprises:

update, by the processor, an estimated first departure time of at least one other vehicle, to provide an updated estimated first departure time to the transport provider based on the difference, the at least one other vehicle being one which is administered by the transport provider and the estimated first departure time of at least one other vehicle being one at which the at least one other vehicle is expected to depart from the first location, and the updated estimated first departure time is within a set prediction window, wherein the at least one other vehicle is one that is in transit, and display, on a display, the updated schedule for trips included in the plurality of trips and the estimated first departure time of at least one other vehicle to the transport provider at a location, wherein the trips will arrive at the location within the prediction window.

10. The apparatus according to claim 9, wherein the at least one memory and the computer program code is further configured with the at least one processor to: receive a first departure time of the at least one other vehicle, the first departure time of the at least one other vehicle being one at which the at least one other vehicle departs from the first location.

11. The apparatus according to claim 10, wherein the at least one memory and the computer program code is further configured with the at least one processor to:

determine a difference between the updated estimated first departure time of the at least one other vehicle and the recorded first departure time of the at least one other vehicle, the difference being a control measure data.

12. The apparatus according to claim 11, wherein the at least one memory and the computer program code is further configured with the at least one processor to:

update the current schedule to provide the updated schedule in response to the determination of the control measure data.

13. The apparatus according to claim 12, wherein the at least one memory and the computer program code is further configured with the at least one processor to:

optimize a headway between the vehicle and the at least one other vehicle in response to the updated schedule.

14. The apparatus according to claim 13, wherein the at least one memory and the computer program code is further configured with the at least one processor to:

receive predetermined data relevant to at least the vehicle; and optimize the headway in response to the receipt of the predetermined data.

15. The apparatus according claim 9, wherein the at least one memory and the computer program code is further configured with the at least one processor to:

receive speed information relating to the vehicle, wherein the current schedule is updated to provide the updated schedule in response to the receipt of the speed information relating to the vehicle.

16. The apparatus according to claim 11, wherein the at least one memory and the computer program code is further configured with the at least one processor to:

display, on the display, the control measure data.

* * * * *